US006300553B2

(12) United States Patent
Kumamoto et al.

(10) Patent No.: US 6,300,553 B2
(45) Date of Patent: Oct. 9, 2001

(54) PITCH SHIFTER

(75) Inventors: Yoshinori Kumamoto, Kasuya-gun; Naoyuki Kato, Izuka, both of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/749,827

(22) Filed: Dec. 28, 2000

(30) Foreign Application Priority Data

Dec. 28, 1999 (JP) ..... 11-373674

(51) Int. Cl.[7] ..... G10H 1/06; G10H 7/00

(52) U.S. Cl. ..... 84/622; 84/604; 84/622; 84/659; 84/661; 84/DIG. 9; 381/98; 381/101

(58) Field of Search ..... 84/600–606, 608, 84/622–625, 627, 659–661, 663, DIG. 9; 381/61–62, 98–99, 101–102; 395/205–207, 500–501

(56) References Cited

U.S. PATENT DOCUMENTS 5,231,671 * 7/1993 Gibson et al. ..... 84/625
5,647,005 * 7/1997 Wang et al. ..... 381/62
6,028,542 * 2/2000 Fukui et al. ..... 341/123

FOREIGN PATENT DOCUMENTS 5-281991 10/1993 (JP) .
5-297891 11/1993 (JP) .
8-241099 9/1996 (JP) .
8-272390 10/1996 (JP) .
9-212193 8/1997 (JP) .

* cited by examiner

*Primary Examiner*—Marlon T. Fletcher
(74) *Attorney, Agent, or Firm*—Wenderoth, Lind & Ponack, L.L.P.

(57) ABSTRACT

A pitch shifter capable of shifting an acoustic signal in pitch to an arbitrary level with a high degree of accuracy without any change in reproduction time, and also sufficiently reducing high-frequency distortion without being increased in size or speeded-up is provided. Stored in a filter coefficient string storage 6, four filter coefficient strings corresponding to four sub-filters produced through polyphase decomposition of a low-pass filter for 4-fold oversampling. Filter coefficient string selectors 5*a* and 5*b* select, based on the first and second bits of the decimal part of each of read addresses generated by the read address generators 4*a* and 4*b*, respectively, any one of the four filter coefficient strings stored in the filter coefficient string storage 6. Filter operation units 2*a* and 2*b* receive paired sound data strings, and carry out a filter operation by using the filter coefficient strings selected by the filter coefficient string selector 5*a* and 5*b*, respectively.

12 Claims, 20 Drawing Sheets

PITCH SHIFTER

BACKGROUND OF THE INVENTION

1. Field of the Invention

The present invention relates to pitch shifters and, more specifically, to a pitch shifter for shifting an acoustic signal in pitch to an arbitrary level.

2. Description of the Background Art

Pitch is a sense of sound, which means the value of frequency. A pitch shifter is a device for shifting an acoustic signal in pitch to a desired level. One well-known example of such pitch shifter is a key controller provided in a karaoke CD (compact disk) player or the like.

FIGS. 16*a* to 16*c* are diagrams in assistance of explaining the principle of shifting an acoustic signal in pitch to a desired level.

As shown in FIGS. 16*a* to 16*c,* an original acoustic signal shown in FIG. 16*a* is compressed to become an acoustic signal as shown in FIG. 16*b* of higher frequencies and pitch, and is extended to become an acoustic signal as shown in FIG. 16*c* of lower frequencies and pitch.

For example, if the acoustic signal is compressed to half along the time axis, the acoustic signal becomes double in frequency, and thus increases in pitch by one octave. On the other hand, if the acoustic signal is extended double along the time axis, the acoustic signal becomes half in frequency, and thus decreases in pitch by one octave.

In general, if the acoustic signal is compressed or extended by $k^{-1}$ (where $0<k$, and $1<k$ for compression, $0<k<1$ for extension) along the time axis, the acoustic signal becomes shifted in frequency by k, and thus in pitch by ($\log_2 k$) octave.

Hereinafter, the above-stated k representing a ratio in pitch of the original acoustic signal to the shifted acoustic signal is referred to as a "pitch shift ratio".

As such, by compressing or extending the acoustic signal along the time axis by $k^{-1}$, the acoustic signal can be changed in frequency by k. Such compression or extension, however, also changes a time length (reproduction time) of the acoustic signal by $k^{-1}$ if no other measures is taken together. Therefore, so-called "crossfading" is further carried out on the acoustic signal to prevent changes in time length.

FIG. 17 is a diagram in assistance for explaining the principle of a crossfading process for smoothly connecting two insuccessive sound frames.

As shown in FIG. 17, consider a case in which a frame B is deleted, and a frame A and a frame C are connected together. In this case, if the frame A and the frame C are connected without any change, discontinuity occurs in signal value at their connecting point, and therefore noise may occur at signal reproduction.

Thus, these frames are connected together with the frame A being faded-out and the frame C being faded-in. Thus, continuity is kept in signal value at their connecting point, and therefore noise is prevented at signal reproduction.

However, if the frame A and the frame C are connected together by crossfading, reproduction time is shortened compared with the case where these frames are connected together without any change. Therefore, a combination of compression/extension along the time axis and crossfading enables shift in pitch of the acoustic signal without any other change.

FIGS. 18*a* and 18*b* are diagrams in assistance for explaining the principle of shifting the acoustic signal in pitch without any change in reproduction time. FIG. 18*a* shows a case in which a signal is increased in pitch, that is, compressed along the time axis (time-axis compression). FIG. 18*b* shows a case in which a signal is decreased in pitch, that is, extended along the time axis (time-axis extension).

In FIGS. 18*a* and 18*b,* a time length of a frame after time-axis compression/extension, that is, an output frame length, is first determined. Then, an input frame length based on the pitch shift ratio is determined. Here, assume that the pitch is multiplied by k, the output frame length is 2, and the input frame length is 2 k.

Next, input frames of each frame length "2k" are sequentially extracted from the original signal as successive two frames overlap each other. The length of an overlapping part is (2k−1). In FIGS. 18*a* and 18*b,* three input frames represented by A1 and B2, A2 and B3, and A3 and B4, respectively, are shown.

Next, each extracted input frame is compressed/extended by $k^{-1}$ along the time axis with reference to the head of each frame (alternatively, with reference to the midpoint or end thereof). Thus, output frames of each frame length "2" can be produced. Among the output frames, successive two output frames overlap each other in half of each frame length.

Specifically, in FIG. 18*a,* (A1H and B2H), (A2H and B3H) and (A3H and B4H) are the output frames, and (B2H and A2H), (B3H and A3H) are the overlapping parts. In FIG. 18*b,* (A1L and B2L), (A2L and B3L), (A3L and B4L) are the output frames, and (B2L and A2L), and (B3L and A3L) are the overlapping parts.

Next, all these output frames are connected together by crossfading. The crossfading process may be carried out over the whole or part of the overlapping parts.

In FIG. 18*a,* two cases are shown, one in which the crossfading process is carried out over the whole of the overlapping parts B2H and A2H, and B3H and A3H, and the other over 25% thereof. Also in FIG. 18*b,* two cases are shown, one in which the crossfading process is carried out over the whole (that is, 100%) of the overlapping parts B2L and A2L, and B3L and A3L, and the other over 25% thereof.

Thus, the acoustic signal can be changed in frequency by k times while being unchanged in reproduction time.

Described below is a conventional pitch shifter for carrying out a pitch shifting process on discrete sound data through crossfading compression/extension.

FIG. 19 is a block diagram showing one example of structure of the conventional pitch shifter. FIG. 20 is a block diagram showing one example of structure of a conventional CD player equipped with the pitch shifter of FIG. 19.

In FIG. 20, a CD 20 has discrete sound data {x(0), x(1), x(2), x(3), . . . } produced by sampling an acoustic signal in every predetermined cycle T and recorded thereon in advance. The CD player includes a reader 21, a reproducer 22, a sound pitch shift ratio setting unit 23, a pitch control signal generator 24, and a sound data output terminal 25, a pitch control signal output terminal 26, and a sound data input terminal 27.

The pitch shift ratio setting unit 23 includes a selector for selecting any of a plurality of predetermined pitch shift ratios or an adjustment control for specifying an arbitrary pitch shift ratio. The pitch shift ratio setting unit 23 sets the pitch shift ratio selected or arbitrarily specified by a user in the CD player. The pitch control signal generator 24 generates a pitch control signal indicating the pitch shift ratio set by the pitch shift ratio setting unit 23. The pitch control signal generated by the pitch control signal generator 24 is outputted from the pitch control signal output terminal 26.

The reader 21 sequentially reads sound the data from the CD 20. The sound data read by the reader 21 is sequentially outputted from the sound data output terminal 25 in every cycle T.

The pitch shifter receives the sound data {x(0), x(1), x(2) x(3), . . .} sequentially outputted from the sound data output terminal 25 and the pitch control signal outputted from the pitch control signal output terminal 26, and then sequentially produces sound data after shifted in pitch {out(0), out(1), out(2), out(3), . . . } in the cycle T.

The sound data after shifted in pitch sequentially produced by the pitch shifter is outputted from the sound data input terminal 27. The reproducer 22 receives the sound data after shifted in pitch {out(0), out(1), out (2), out(3), . . . } outputted from the sound data input terminal 27, and reproduces the acoustic signal. The acoustic signal reproduced by the reproducer 22 is amplified by an amplifier not shown, and then provided to a speaker.

In FIG. 19, the conventional pitch shifter includes memory unit 1, paired read address generators 4*a* and 4*b* that are identical in structure, paired interpolators 10*a* and 10*b*, a crossfader 3, a sound data input terminal 7, a sound data output terminal 8, and a pitch control signal input terminal 9.

The sound data {x(0), x(1), x(2), x(3), . . . } outputted from the sound data output terminal 25 of the CD player is provided to the sound data input terminal 7. The memory unit 1 temporarily stores the sound data.

The pitch control signal outputted from the pitch control signal output terminal 26 is provided to the pitch control signal input terminal 9. The read address generators 4*a* and 4*b* each generate, based on the pitch control signal, a read address for reading the sound data temporarily stored in the memory unit 1. That is, the pitch shift ratio indicated by the pitch control signal is accumulated as an address increment value, and the accumulation result is outputted as a read address.

FIG. 21 is a block diagram showing one example of structure of the read address generator 4*a* or 4*b* of FIG. 19.

In FIG. 21, either the read address generator 4*a* or 4*b* includes an accumulator (ALU) 16 for accumulating the address increment value (=k). An example of such structured address generator is disclosed in Japanese Patent Laid-Open Publication No. 9-212193 (1997-212193).

Thus, the address generator produces, for example, {0, 1, 2, 3, . . . } if the pitch shift ratio k is 1 (no pitch shift ) , and {0, 2, 4, 6, . . . } if k=2. Also, the address generator produces, for example, {0, 0.5, 1, 1.5, . . . } if k=0.5, and {0, 1.26, 2.52, 3.78, . . . } if k=1.26.

Note that the read address generators 4*a* and 4*b* generate addresses differed from each other by a predetermined value.

For example, if {0, 1, 2, 3, 4, . . . } is generated by one address generator, {4, 5, 6, 7, 8, . . . } is generated by the other address generator. In other words, a set of read addresses (0, 4) is generated at a certain time; another set of read addresses (1, 5) is generated after the time T has elapsed from the certain time; still another set of read addresses (2, 6) is generated after the time T has elapsed, and the process continues in the same manner.

The difference between these two read addresses is determined based on the output frame length, pitch shift ratio (refer to FIGS. 18*a* and 18*b*), and other factors. How to determine the difference is not directly related to the present invention, and therefore is not described herein.

Referring back to FIG. 19, the memory unit 1 reads the sound data stored in advance, based on the read addresses generated by the read address generators 4*a* and 4*b*. For example, if the pitch shift ratio is doubled, the read address generator 4*a* generates a read address {0, 2, 4, . . . }, and the memory unit 1 sequentially reads the sound data {x(0), x(2), X(4), . . . } in the cycle T. In such manner, ½ compression in time axis is carried out.

In other words, in the conventional pitch shifter, the memory unit 1 and the read address generators 4*a* and 4*b* achieve the above described compression/extension in time axis.

However, for example, if the pitch shift ratio is 1.26, a read address {0, 1.26×1, 1.26×2, . . . } is generated, but sound data such as x(1.26×1) and x(1.26×2) does not exist in the memory unit 1. Therefore, to achieve an arbitrary pitch shift ratio, interpolators 10*a* and 10*b* for calculating interpolation values from the sound data stored in the memory unit 1 are further required. The interpolator 10*a* generates an interpolation value based on the read address generated by the read address generator 4*a* and the sound data read from the memory unit 1 based on the generated address. The interpolator 10*b* generates an interpolation value based on the read address generated by the read address generator 4*b* and the sound data read from the memory unit 1 based on the generated interpolation value. Note that if the pitch shift ratio is an integer, that is, does not have any valid decimal part, no interpolation data is required.

With these interpolators 10*a* and 10*b* further provided, the pitch shifter can carry out compression/extension in time axis even if the pitch shift ratio has a decimal part. In other words, the acoustic signal can be shifted in pitch to an arbitrary level.

The crossfader 3 receives interpolated sound data outputted from the interpolator 10*a* and interpolated sound data outputted from the interpolator 10*b*, and carries out crossfading thereon. That is, each sound data is multiplied by a crossfading coefficient (which will described later), and then added together.

With such crossfader 3 further provided, the pitch shifter can shift an acoustic signal in pitch to an arbitrary level without any change in reproduction time.

From the sound data output terminal 8, sound data after subjected to crossfading compression/extension, that is, sound data shifted in pitch, is outputted.

The operations of the above-structured CD player and the conventional pitch shifter provided therein are described below.

In FIG. 20, the user first specifies, through an adjustment control not shown, a desired pitch shift ratio k, and then presses a PLAY button (not shown) provided thereon.

In response, in the CD player, the pitch shift ratio setting unit 23 first sets the pitch shift ratio k therein. Then, the reader 21 starts to read the sound data from the CD 20 in the cycle T. Also, the pitch shift ratio setting unit 23 starts to generate a pitch control signal indicating the pitch shift ratio k. Note that the pitch shift ratio k set in the above manner may be shifted to another value after the start of reproduction.

Thus read sound data and the generated pitch control signal are provided to the conventional pitch shifter through the sound data input terminal 7 and the sound control signal input terminal 9, respectively.

In FIG. 19, the provided input data is temporarily stored in the memory unit 1.

FIGS. 22*a,* 22*b,* and 22*c* are diagrams showing at a glance a pitch shifting process carried out by the pitch shifter of FIG. 19.

FIG. 22*a* is a diagram showing at a glance how the memory unit 1 of FIG. 11 stores sound data.

In FIG. 22*a,* x(0), x(1), x(2), . . . each are sound data. The horizontal axis represents real time t in units of the sampling cycle T, and also represents addresses on a buffer in the memory unit 1. A signal value of each sound data is represented by a distance from the horizontal axis.

As shown in FIG. 22*a,* the memory unit 1 stores the inputted sound data in sequence such as x(0) in address 0, x(1) in address 1, and x(2) in address 2.

On the other hand, the inputted pitch control signal is branched into two, and given to the read address generators 4*a* and 4*b*. Based on the given sound control signal, the read address generators 4*a* and 4*b* each generate a read address differed from each other by a predetermined value in the cycle T.

The generated paired read addresses are given to the memory unit 1 and the interpolators 10*a* and 10*b*. The memory unit 1 reads the sound data stored in advance (refer to FIG. 22*a*), based on the given paired read addresses.

FIG. 23 is a diagram showing a relation, on the buffer in the memory unit 1 of FIG. 19, between a write position of the inputted sound data and read positions of the sound data written in advance based on the addresses from the paired read address generators 4*a* and 4*b,* where the pitch is shifted to higher.

In FIG. 23, "w" is a write address pointer indicating a position on the buffer to which the sound data is written. "r1" and "r2" are read address pointers each indicating a position on the memory unit corresponding to the address from the address generator, that is, a position on the buffer from which the sound data is read based on the address.

Here, with reference to FIG. 23, described is how the memory unit 1 writes the inputted sound data in the buffer and reads the sound data from the buffer based on the given paired read addresses.

First, as shown in a top portion of FIG. 23, "r1" is located in a rearward position from "w" for a predetermined distance d, while "r2" is located in a rearward position from "r1" for the distance d. Here, a direction in which the pointer proceeds is a forward direction. After writing/reading starts, "r1" proceeds faster than "w", and "r2" proceeds as fast as "r1". Then, when "r1" catches up with "w", "r1" jumps to a rearward position from "r2" for the distance d.

The loci of "r1" and "r2" correspond to the area B2 and the area A2 shown in FIG. 18*a,* respectively.

Immediately after the jump of "r1", as shown in a middle portion of FIG. 23, "r2" is located in a rearward position from "w" for the distance d, while "r1" is located at a rearward position from "r2" for the distance d. Then, "r2" proceeds faster than "w", and "r1" proceeds as fast as "r2". Then, when "r2" catches up with "w", "r2" jumps to a rearward position from "r1" for the distance d.

The loci of "r2" and "r1" correspond to the area B3 and the area A3, respectively.

Immediately after the jump of "r2", as shown in a bottom portion of FIG. 23, "r1" is located at a rearward position from "w" for the distanced, while "r2" is located at a rearward position from "r1" for the distance d. Thereafter, "w", "r1", and "r2" each move in the same manner as described above.

Referring back to FIG. 19, if the read address generated by the address generator does not represent an integer, in parallel with the above writing/reading, that is, compression/extension in time axis, an interpolation process is carried out by the memory unit 1 and the interpolators 10*a* and 10*b*. This interpolation process is described below.

If the read address represents an integer (that is, does not have any valid decimal part), the memory unit 1 reads the sound data stored in an address corresponding to the read address. However, if the read address has any valid decimal part, the memory unit 1 reads two pieces of sound data stored in addresses adjacent to the read address, that is, addresses immediately preceding and succeeding the read address.

Therefore, for example, if the read address represents 0, single sound data x(0) is read. If 0.5, two pieces of sound data x(0) and x(1) are read. Similar, if 1.26, two pieces of sound data x(1) and x(2) are read.

The sound data read based on the address generated by the read address generator 4*a* is given to the interpolator 10*a*. The sound data based on the address generated by the read address generator 4*b* is given to the interpolator 10*b*.

The interpolators 10*a* and 10*b* each calculate an interpolation value based on the given sound data and read address, and produces interpolated sound data.

In other words, the interpolators 10*a* and 10*b* each output single sound data given by the memory unit 1 as the interpolated sound data if the read address does not have any decimal part. If the read address has any decimal part, the interpolators 10*a* and 10*b* each calculate an interpolation value based on that decimal part and the signal values of two pieces of sound data given by the memory unit 1, and then each produce the interpolation value as the interpolated sound data.

Calculation of the interpolation value is performed typically by so-called "linear interpolation".

FIG. 22*b* is a diagram showing, at a glance, linear interpolation performed by the interpolator 10*a* and 10*b,* where the pitch shift ratio k is 1.26.

In FIG. 22*b,* x(0), x(1), x(2), . . . each are the sound data stored in the memory unit 1, and y(1.26), y(1.26×2), . . . are the interpolation values.

As shown in FIG. 22*b,* if the read address is 1.26, the interpolators 10*a* and 10*b* each calculate the interpolation value y(1.26) from a decimal part 0.26 and the sound data x(1) and x(2) by using the following equation (1).

$$y(1.26)=x(1)+0.26\times\{x(2)-x(1)\} \quad (1)$$

Similarly, if the read address is 1.26, the interpolators 10*a* and 10*b* each calculate the interpolation value y(1.26×2) from a decimal part (1.26×2−2) and the sound data x(2) and x(3) by using the following equation (1).

$$y(1.26\times2)=x(2)+(1.26\times2-2)\times\{x(3)-x(2)\} \quad (2)$$

In general, if the read address is (k×n) (k is pitch shift ratio, and n is an arbitrary integer), the interpolators 10*a* and 10*b* each calculate an interpolation value y(k×n) from a decimal part (k×n−m) and sound data x(m) and x(m+1) by using the following equation (3).

$$y(k\times n)=x(m)+(k\times n-m)\times\{x(m+1)-x(m)\} \quad (3)$$

A pair of sound data is sequentially outputted in the cycle T from the interpolators 10*a* and 10*b* to the crossfader 3. The crossfader 3 carries out crossfading on the paired sound data.

The crossfader 3 stores in advance paired crossfading coefficients by which the paired sound data are multiplied.

FIG. 24 is a diagram showing one example of such paired crossfading coefficients by which the crossfader 3 of FIG. 19 multiplies the paired sound data.

In FIG. 24, $\alpha$ represents a position of sound data in frame from the head. $V(\alpha)$ is a crossfading coefficient by which the $\alpha$-th sound data in frame from the head is multiplied. Assume the number of sound data included in one frame is $\alpha_0$, if $\alpha=0$, $V(\alpha)=0$. Also, if $=\alpha_0/2$, $V(\alpha)=1$.

The crossfader 3 detects the position of the interpolated pair of sound data in frame from the head by counting the number of interpolated paired sound data provided thereto. For example, for $n_1$ and $n_2$ interpolated sound data, paired $V(\alpha)$ corresponding to $\alpha=n_1$ and $n_2$ are calculated. Then, each sound data is multiplied by its corresponding $V(\alpha)$ and the multiplication results are added together.

Then, the addition result, that is, the sound data after shifted in pitch, {y'(0), y'(k×1), y'(k×2), . . . } is outputted in the cycle T to the outside of the pitch shifter through the sound data output terminal 8.

The sound data after shifted in pitch {y'(0), y'(k×1), y'(k×2), . . . } outputted from the pitch shifter is again provided to the CD player through the sound data input terminal 27.

In FIG. 20, the sound data after shifted in pitch provided through the sound data input terminal 27 is given to the reproducer 22. The reproducer 22 reproduces the acoustic signal from the provided sound data after shifted in pitch.

The acoustic signal reproduced in the above-described manner is amplified through an amplifier (not shown), and then provided to the speaker, and then converted into an acoustic wave.

FIG. 22*c* is a diagram showing at a glance the acoustic signal reproduced from the sound data after shifted in pitch.

In FIG. 22*c*, {out(0), out(1), out(2), . . . } is an acoustic signal that corresponds to the sound data after shifted in pitch {y'(0), y'(k×1), y'(k×1), . . . }. The horizontal axis represents real time t by a unit of the cycle T.

As described above, in the conventional pitch shifter, the acoustic signal can be shifted in pitch through crossfading compression/extension without any change in reproduction time.

However, linear interpolation carried out at compression/extension could cause a large difference between an ideal value and the interpolation value, and thus signal distortion may occur at high frequencies.

Therefore, in order to reduce signal distortion at high frequencies, oversampling is suggested. In oversampling, a sampling frequency $T^{-1}$ of sound data is shifted into a higher frequency $N^{T-1}$ (where N is a power of 2). N is hereinafter referred to an oversampling ratio.

FIG. 25 is a block diagram showing the structure of another conventional pitch shifter. As the pitch shifter of FIG. 19, the pitch shifter of FIG. 25 is, for example, provided in the CD player of FIG. 20.

In FIG. 25, this pitch shifter includes the memory unit 1, the paired read address generators 4*a* and 4*b*, the paired interpolators 10*a* and 10*b*, the crossfader 3, the sound data input terminal 7, the sound data output terminal 8, the pitch control signal input terminal 9, an oversampler 11, and a downsampler 12.

In other words, the pitch shifter of FIG. 25 is similar in structure to that of FIG. 19 except the over sampler 11 and the downsampler 12 are additionally provided.

The oversampler 11 receives the sound data {x(0), x(1), x(2), . . . } through the sound data input terminal 7, and carries out oversampling on the received sound data. Note that described hereinafter is a case in which the oversampling ratio is 2.

More specifically, the oversampler 11 includes an interpolator 13 and an anti-aliasing filter (low-pass filter 14*a*) for eliminating aliasing. First, the oversampler 11 inserts a value of 0 between two pieces of sound data, that is, x(0) and x(1), x(1) and x(2), . . . Then, the oversampler 11 carries out a filter operation in a cycle {(½)×T} based on the 0-inserted sound data {x(0), 0, x(1), 0, x(2), 0, . . . } to calculate sound data {x'(0), x'(0.5), x'(1), x'(1.5), x'(2), x'(2.5), . . . }.

The downsampler 12 receives the sound data shifted in pitch {y'(0), y'(k×0.5), y'(k×1), y'(k×1.5), y'(k×2),. y'(k×2.5), . . . } outputted from the crossfader 3, and carries out downsampling on the received sound data.

More specifically, the downsampler 12 includes an anti-aliasing filter (low-pass filter 14*b* ) having a characteristic of eliminating aliasing and a decimator 15. First, the downsampler 12 carries out a filter operation in the cycle {(½)×T} based on the sound data {y'(0), y'(k×0.5), y'(k×1), y'(k×1.5), y'(k×2), . y'(k×2.5), . . . } to calculate sound data {y"(0), y"(k×0.5), y"(k×1), y",(k×1.5), y"(k×2),. y"(k×2.5), . . . }. Then, the downsampler 12 decimates {y"(k×0.5), y"(k×1.5), y"(k×2.5), . . . } in the sound data {y"(0), y"(k×0.5), y"(k×1.0), y"(k×1.5), y"(k×2.0), y"(k×2.5), . . . }.

Each of the components other than the oversampler 11 and the downsampler 12 basically carries out a similar operation to that carried out by each corresponding component of the pitch shifter shown in FIG. 19. The difference is that the operation cycle becomes half to be {(½)×T}, and that the buffer in memory unit 1 has to be doubled in capacity. In general, if the oversampling ratio is N, the operation cycle is $\{N^{-1}\times T\}$, and the buffer in the memory unit 1 has to be increased by N times in capacity.

The pitch shifter of FIG. 25 is different in operation from that of FIG. 19 in the following two points.

First, in addition to the pitch shifting process, the oversampling process is carried out. More specifically, interpolation and filter operation are carried out before pitch shift, and filter operation and decimation are carried out after pitch shift.

Secondly, the number of sound data is increased by oversampling, and thus the amount of operation per unit time for a pitch shifting process is increased. More specifically, if the oversampling ratio is N, the operation cycle of the interpolators 10*a* and 10*b* and the crossfader 3 becomes $\{N^{-1}\times T\}$.

The sound data outputted from the pitch shifter of FIG. 25 is different from that from the pitch shifter of FIG. 19, which will be described below with reference to the drawings.

FIGS. 26*a* to 26*c* are diagrams showing at a glance the pitch shifting process carried out by the pitch shifter of FIG. 25.

As can been seen by comparing FIGS. 26*a* to 26*c* with FIG. 22, double oversampling reduces a time interval between two successive sound data by half. In general, if the oversampling ratio is N, the time interval is reduced by $N^{-1}$. Therefore, pieces of sound data more adjacent to each other in address are used for calculating interpolation values when the read address has a decimal part. As a result, the calculated interpolation values can be more close to true values.

Therefore, the sound data {y"(0), y"(k×1), y"(k×2), . . . } outputted from the sound data output terminal 8 of the pitch shifter of FIG. 15 is reduced in signal distortion at high frequencies, compared with the sound data {y(0), y(k×1), y"(k×2), . . . } outputted from the sound data output terminal 8 of the pitch shifter of FIG. 19. Therefore, as the oversampling ratio is larger, signal distortion at high frequencies becomes smaller.

As described above, the conventional pitch shifter operates based on the principle of crossfading compression/ extension. Also, the conventional pitch shifter carries out linear interpolation if the pitch shift ratio has a decimal part. Therefore, an acoustic signal can be shifted in pitch to an arbitrary level with a high degree of accuracy. However, interpolation values produced through linear interpolation differ at high frequencies from true values. Thus, in the conventional pitch shifter, distortion in acoustic signal at high frequencies (hereinafter referred to as "high-frequency distortion") is a serious problem.

To solve the problem, it has been suggested that oversampling is further performed in the conventional pitch shifter. That is because oversampling can reduce the difference between the interpolation values produced through linear interpolation and the true values, and thus can reduce high-frequency distortion. The effect of reduction in high-frequency distortion becomes more significant as the oversampling ratio is larger.

However, the above-structured conventional pitch shifter is further provided with not only the oversampler 11 but also the downsampler 12, and thus becomes greatly increased in size.

Moreover, in the above-structure conventional pitch shifter, the oversampler 11 and the downsampler 12 have to execute the filter operation in the cycle $\{T \times N^{-1}\}$ when carrying out N-fold oversampling. Then, as a result of N-fold oversampling, the number of sound data is increased by N times, compared with the number of sound data when oversampling is not performed. Thus, the buffer in the memory unit 1 has to be increased by N times in capacity. Also, the crossfader 3 and the interpolators 10*a* and 10*b* have to operate in the cycle $\{T \times N^{-1}\}$. In short, as the oversampling ratio becomes larger, the buffer in the memory unit 1 has to be larger in capacity and the low-pass filters 14*a* and 14*b* of the oversampler 11 and the downsampler 12, respectively, the interpolators 10*a* and 10*b*, the crossfader 3, and other components have to operate faster. Therefore, the pitch shifter becomes sharply increased in cost.

SUMMARY OF THE INVENTION

Therefore, an object of the present invention is to provide a pitch shifter capable of shifting an acoustic signal in pitch to an arbitrary level with a high degree of accuracy without any shift in production time of the acoustic signal, and also sufficiently reducing high-frequency distortion without being increased in size or speeded-up.

The present invention has the following features to achieve the object above.

A first aspect of the present invention is directed to a pitch shifter for shifting an acoustic signal in pitch to an arbitrary level without any change in reproduction time, the pitch shifter comprising:

a sound data input terminal sequentially provided discrete sound data produced by sampling the acoustic signal;

a pitch control signal input terminal provided with a pitch control signal indicating a pitch shift ratio;

paired read address generators each for generating, based on the pitch control signal provided through the pitch control signal input terminal, a read address differed from each other by a predetermined value;

a memory unit including a buffer, for sequentially writing, in the buffer, the sound data provided through the sound data input terminal and reading, from the buffer, paired sound data strings based on integer-part bits of each of the read addresses generated by the read address generators;

a filter coefficient string storage for storing, in a predetermined order, N filter coefficient strings corresponding to N sub-filters produced through polyphase decomposition of a low-pass filter for N-fold oversampling (N is a power of 2);

paired filter coefficient string selectors each for selecting, based on first to ($\log_2 N$)-th bits of a decimal part of each of the read addresses generated by the read address generators, any one of the N filter coefficient strings stored in the filter coefficient string storage;

paired filter operation units each for carrying out a filter operation on each of the paired sound data strings read by the memory unit by using the filter coefficient selected by the filter coefficient string selector; and a crossfader for multiplying each of paired sound data outputted from the filter operation units by a crossfading coefficient, and adding multiplication results together.

In the first aspect, the pitch shifter can be smaller in size cost than that carrying out oversampling, but approximately equal thereto in the amount of reduction in high-frequency distortion.

Furthermore, if carrying out N-fold oversampling, the conventional pitch shifter requires N-fold buffer capacity, and $N^{-1}$-fold cycle of the filter operation. However, in the first aspect, the capacity of the buffer included in the memory unit can be fixed irrespectively of N. Also, the filter operation can be executed in a fixed cycle irrespectively of N. Therefore, the oversampling ratio N can be sufficiently increased without increase in cost and size of the pitch shifter. With sufficient large N, pitch shift can be carried out with high accuracy even without linear interpolation.

In addition, the filter coefficient string is selected based on the first to ($\log_2 N$)-th bits of the decimal part of the read address. Therefore, the filter operation is easily carried out without increase in size of the pitch shifter.

According to a second aspect, in the first aspect, each of the read address generators includes an accumulator for accumulating the pitch shift ratio.

According to a third aspect, in the first aspect, each of the read address generators includes an accumulator for accumulating a predetermined value, and a multiplier for multiplying an output from the accumulator by the pitch shift ratio.

In the second and third aspects, the read address for reading the sound data from the buffer and selecting the filter coefficient string can be generated.

According to a fourth aspect, in the first aspect, when reading the paired sound data strings from the buffer, the memory unit further reads, from the buffer, other paired sound data strings that are identical to or differed from the paired sound data strings in address by one, the paired filter coefficient string selectors each further select other paired filter coefficient strings adjacent to the filter coefficient strings, the pitch shifter further comprises other paired filter operation units for carrying out the filter operation on the other paired sound data strings read by the memory unit by using the other filter coefficient strings selected by the filter coefficient string selectors; and paired interpolators, provided with the paired sound data outputted from the paired filter operation units and paired sound data outputted from the other paired filter operation units, for generating paired interpolation data interpolating two adjacent sound data by calculating a linear interpolation value with $\{\log_2 N+1\}$ bits or lower of each of the read addresses generated by the read address generators, and the crossfader is provided with paired sound data outputted from the paired interpolators.

In the fourth aspect, pitch shift with higher accuracy can be carried out.

According to a fifth aspect, in the fourth aspect, each of the read address generators includes an accumulator for accumulating the pitch shift ratio.

According to a sixth aspect, in the fourth aspect, each of the read address generators includes an accumulator for accumulating a predetermined value, and a multiplier for multiplying an output from the accumulator by the pitch shift ratio.

In the fifth and sixth aspects, the read address for reading the sound data from the buffer and selecting the filter coefficient string can be generated.

A seventh aspect is directed to a pitch shifter for shifting an acoustic signal in pitch to an arbitrary level without any change in reproduction time, the pitch shifter comprising:

a sound data input terminal sequentially provided discrete sound data produced by sampling the acoustic signal;

a pitch control signal input terminal provided with a pitch control signal indicating a pitch shift ratio;

a single read address generator for generating, based on the pitch control signal provided through the pitch control signal input terminal, a read address;

a memory unit including a buffer, for sequentially writing, in the buffer, the sound data provided through the sound data input terminal and reading, from the buffer, paired sound data strings differed from each other by a predetermined number of addresses based on integer-part bits of each of the read addresses generated by the read address generator;

a crossfader for multiplying each of sound data forming the paired sound data strings read from the memory unit by a crossfading coefficient, and adding multiplication results together;

a filter coefficient string storage for storing N filter coefficient strings corresponding to N sub-filters produced through polyphase decomposition of a low-pass filter for N-fold oversampling (N is a power of 2);

a single filter coefficient string selector for selecting, based on first to $(\log_2 N)$-th bits of a decimal part of the read address generated by the read address generator, any one of the N filter coefficient strings stored in the filter coefficient string storage; and a single filter operation unit for carrying out a filter operation on the sound data string outputted from the crossfader by using the filter coefficient selected by the filter coefficient string selector.

In the seventh aspect, the pitch shifter can be smaller in size cost than that carrying out oversampling, but approximately equal thereto in the amount of reduction in high-frequency distortion.

Furthermore, if carrying out N-fold oversampling, the conventional pitch shifter requires N-fold buffer capacity, and $N^{-1}$-fold cycle of the filter operation. However, in the first aspect, the capacity of the buffer included in the memory unit can be fixed irrespectively of N. Also, the filter operation can be executed in a fixed cycle irrespectively of N. Therefore, the oversampling ratio N can be sufficiently increased without increase in cost and size of the pitch shifter. With sufficient large N, pitch shift can be carried out with high accuracy even without linear interpolation.

In addition, the filter coefficient string is selected based on the first to $(\log_2 N)$-th bits of the decimal part of the read address. Therefore, the filter operation is easily carried out without increase in size of the pitch shifter.

The above-stated effects are the same as those in the first aspect. Furthermore, in the seventh aspect, only the single read address generator, the single filter coefficient string selector, and the single filter operation unit are required. Thus, the pitch shifter is smaller in size than that according to the first aspect.

According to an eighth aspect, in the seventh aspect, the read address generators includes an accumulator for accumulating the pitch shift ratio.

According to a ninth aspect, in the seventh aspect, the read address generators includes an accumulator for accumulating a predetermined value, and a multiplier for multiplying an output from the accumulator by the pitch shift ratio.

In the eighth and ninth aspects, the read address for reading the sound data from the buffer and selecting the filter coefficient string can be generated.

According to a tenth aspect, in the seventh aspect, on the buffer, a write address pointer indicating a position to which the sound data inputted through the sound data input terminal is written and paired read address pointers each indicating a head position of each of the paired sound data read are provided, and the buffer is a ring buffer whose head and end are connected together and having capacity equivalent to a distance between the paired read address pointers, the memory unit gives a distance between either one of the paired read address pointers and the write address pointer, and the crossfader multiplies each of sound data forming the paired sound data strings by the crossfading coefficient according to the distance given from the memory unit.

In the tenth aspect, based on the distance between either one of the paired read address pointers and the write address pointer, the crossfading coefficient to be used in multiplication of the paired sound data strings is calculated.

According to an eleventh aspect, in the tenth aspect, the read address generator includes an accumulator for accumulating the pitch shift ratio.

According to a twelfth aspect, in the tenth aspect, the read address generator includes an accumulator for accumulating a predetermined value, and a multiplier for multiplying an output from the accumulator by the pitch shift ratio.

In the eleventh and twelfth aspects, the read address for reading the sound data from the buffer and selecting the filter coefficient string can be generated.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
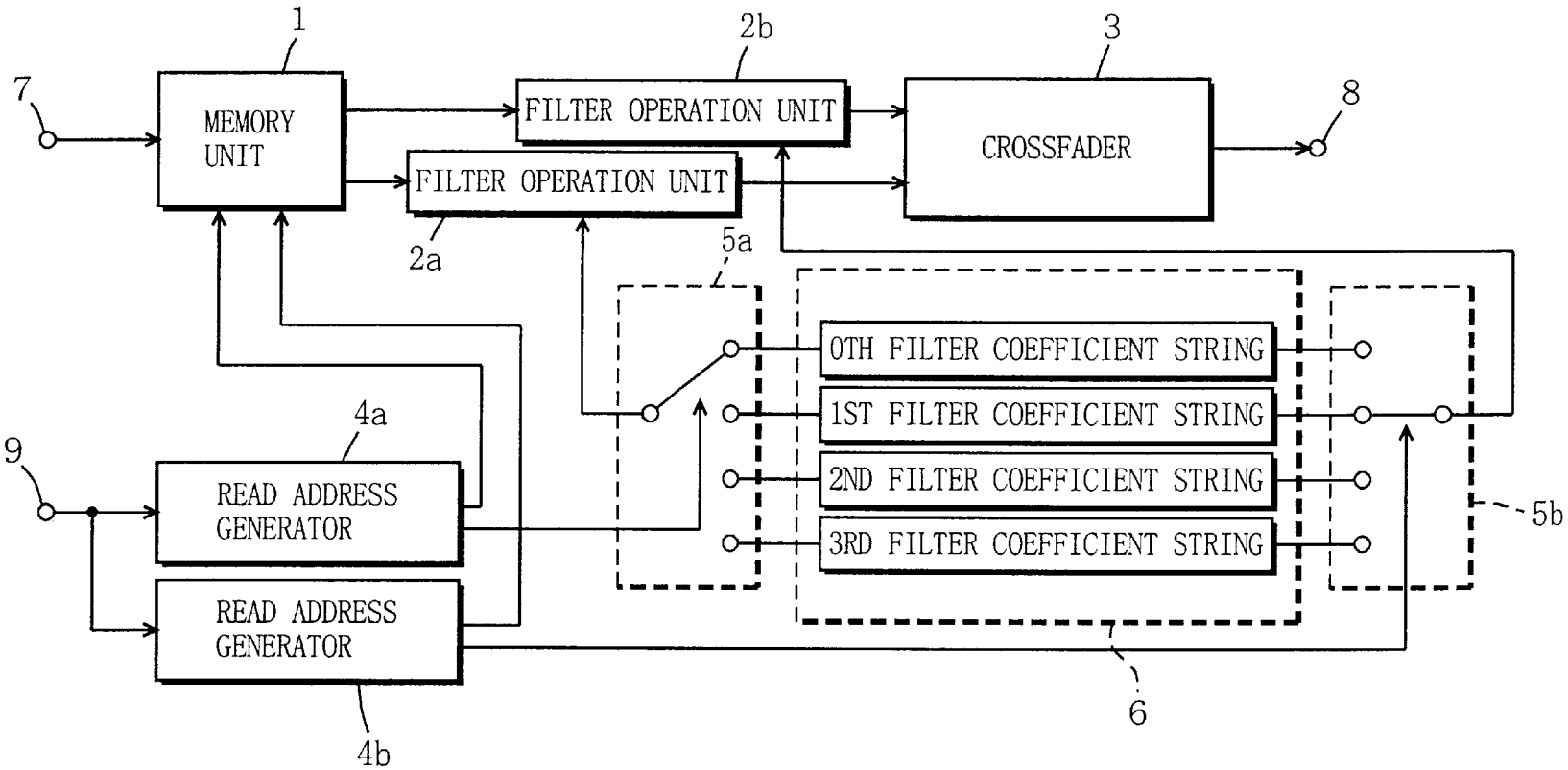
FIG. 1 is a block diagram showing the structure of a pitch shifter according to a first embodiment of the present invention.

Embodiments of the present invention are now described below with reference to the drawings. Note that conventional art already described in Background Art section is not described herein in detail.

Also in the following description, "k" represents the pitch shift ratio, "T" represents the cycle for sampling sound data, "t" represents real time by a unit of T, and "N" represents the oversampling ratio (refer to Background Art section).

(First Embodiment)

An overview of a pitch shifter according to a first embodiment of the present invention is first described before details thereof are discussed.

Similarly to the conventional pitch shifter, the pitch shifter according to the first embodiment shifts an acoustic signal in pitch through compression/extension in time axis and crossfading without any change in reproduction time.

Also, the pitch shifter according to the first embodiment accumulates the pitch shift ratio, and uses the accumulation result as the read address, similarly to the conventional pitch shifter.

The pitch shifter according to the present invention is different from the conventional pitch shifter in the following points.

(I) The present pitch shifter does not apparently carry out oversampling, but carries out an filter operation by using sub-filters produced through polyphase decomposition of the low-pass filter 14*a* or 14*b* used for oversampling.

More specifically, the another conventional pitch shifter (refer to FIG. 25) is provided with the oversampler 11 preceding to the memory unit 1. The low-pass filter 14*a* included in the oversampling 11 carries out the operation in the cycle ($T \times N^{-1}$) at N-fold oversampling. The resultant sound data of the sampling cycle ($T \times N^{-1}$) is temporarily stored in the memory unit 1. Therefore, the capacity of the buffer in the memory unit 1 has to be N times when oversampling is not carried out.

On the other hand, the pitch shifter according to the first embodiment is provided with filter operation units that carry out operation in the cycle T by using any one of N sub-filters. N sub-filter is produced through polyphase decomposition of the low-pass filter 14*a* included in the oversampler 11. Note that the number of taps of each sub-filter is $N^{-1}$ times as that of the low-pass filter 14*a*. Therefore, the buffer capacity of the memory unit 1 is the same as that in a case where oversampling is not carried out.

That is, the pitch shifter according to the first embodiment becomes $N^{-1}$ times in the buffer capacity of the memory unit 1 and N times in cycle of filter operation (that is, $N^{-1}$ times in operation) more than the pitch shifter that carries out N-fold oversampling. Nevertheless, the pitch shifter according to the first embodiment has the same effect of high-frequency reduction as that of the pitch shifter that carries out N-fold oversampling.

In other words, the buffer capacity of the memory unit 1 can be fixed irrespectively of the oversampling ratio N. Also, like the crossfading compression/extension, filter operation can be executed in a fixed cycle irrespectively of the oversampling ratio N, that is, in the same cycle as that of the sampling frequency of sound data (=T). Therefore, the oversampling ratio N can be increased without sharp increase in the cost of the pitch shifter.

If the oversampling ratio is sufficiently increased, pitch shift can be carried out with high accuracy even without linear interpolation. Thus, the pitch shifter can be downsized because of not requiring the interpolators 10*a* and 10*b*.

If the oversampling ratio is small, the pitch shift ratio varies with time. Therefore, pitch shift is not carried out with high accuracy without linear interpolation.

(II) By using the first to ($\log_2$N)-th bits of the decimal part of the read address, any one of the N sub-filter is selected. Thus, filter selection is easily carried out without increase in size of the pitch shifter.

The pitch shifter according to the first embodiment of the present invention is now described below in detail.

FIG. 1 is a block diagram showing the structure of the pitch shifter according to the first embodiment of the present invention.

Figure 12:
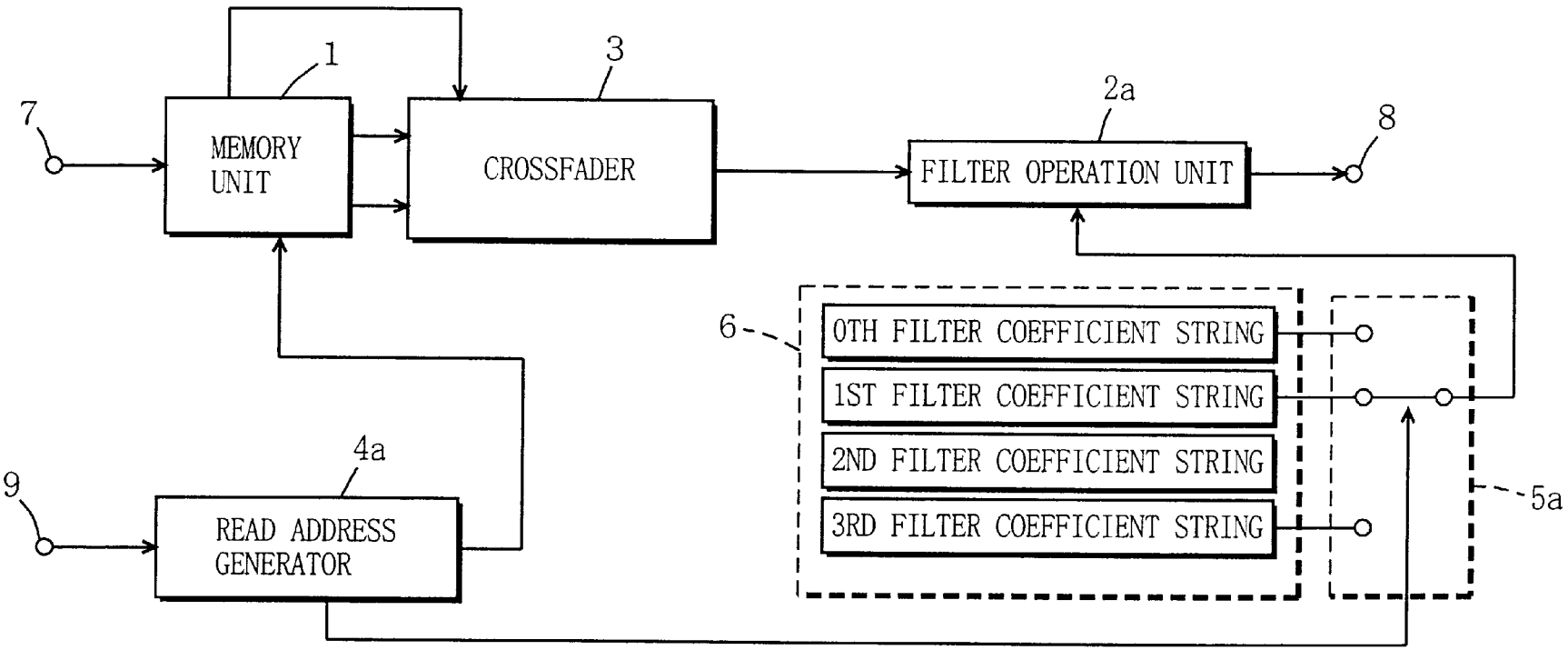
FIG. 12 is a block diagram showing the structure of a pitch shifter according to a third embodiment of the present invention.

The pitch shifter according to the first embodiment is provided, for example, to the conventional CD player as shown in FIG. 12.

In FIG. 1, the pitch shifter according to the first embodiment includes the memory unit 1, paired filter operation units 2*a* and 2*b*, the crossfader 3, the paired read address generators 42*a* and 4*b*, paired filter coefficient string selectors 5*a* and 5*b*, a filter coefficient string storage 6, the sound data input terminal 7, the sound data output terminal 8, and the sound control signal input terminal 9. Note that the components that are identical to those in the conventional pitch shifter (refer to FIG. 19) are provided with the same reference numerals.

In the pitch shifter according to the first embodiment, compression/extension in time axis and crossfading with reference to the pitch shift ratio are carried out through the memory unit 1, the read address generator 4*a* and 4*b*, and the crossfader 3, and thus the acoustic signal is shifted in pitch without any change in reproduction time. This is the same as that in the conventional pitch shifter.

Additionally, in the pitch shifter according to the first embodiment, only the sound data required is calculated with filter operation through the filter operation units 2*a* and 2*b*, the filter coefficient string selectors 5*a* and 5*b*, and the filter coefficient string storage 6. This is different from the conventional pitch shift that carries out oversampling and calculation of interpolation values together.

Here, for simplification, assume that the oversampling ratio N is 4.

First, 4-fold oversampling is briefly described.

Figure 2A:
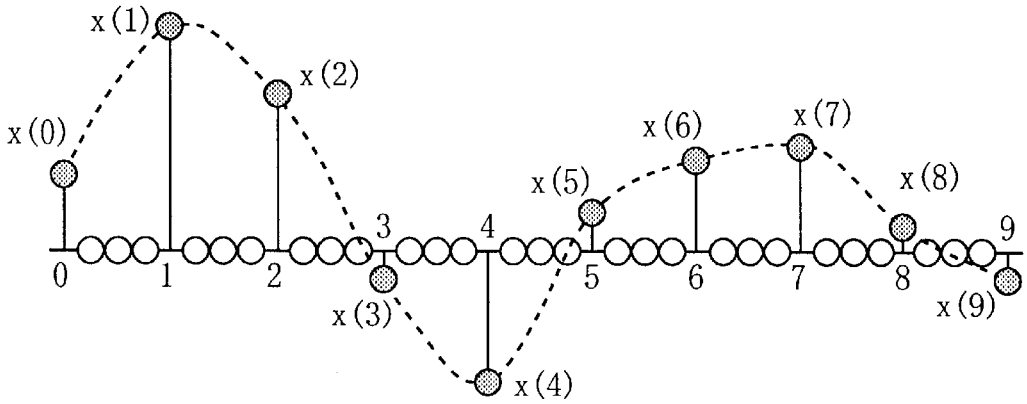
FIGS. 2*a* to 2*c* are diagrams showing a relation between sound data calculated by filter operation units 2*a* and 2*b* on the pitch shifter of FIG. 1 (where the pitch shift ratio is 1.26) and sound data produced when an oversampler 11 of a pitch shifter of FIG. 25 carries out 4-fold oversampling.
Figure 2B:
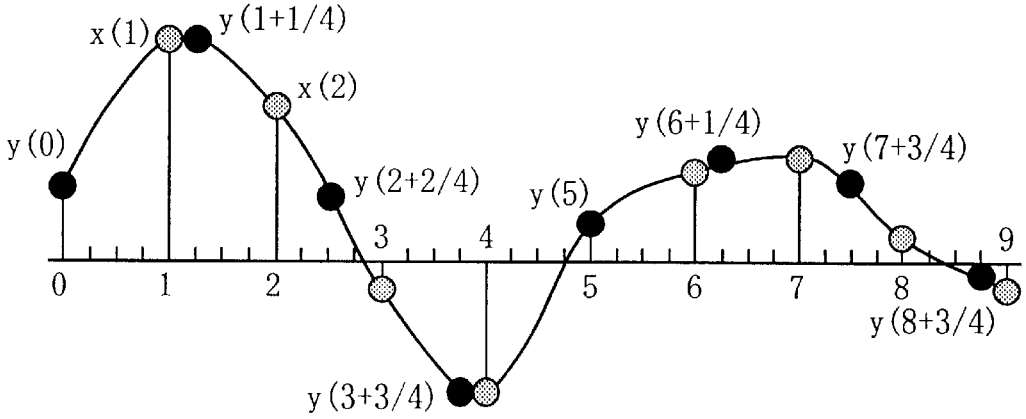
Figure 2C:
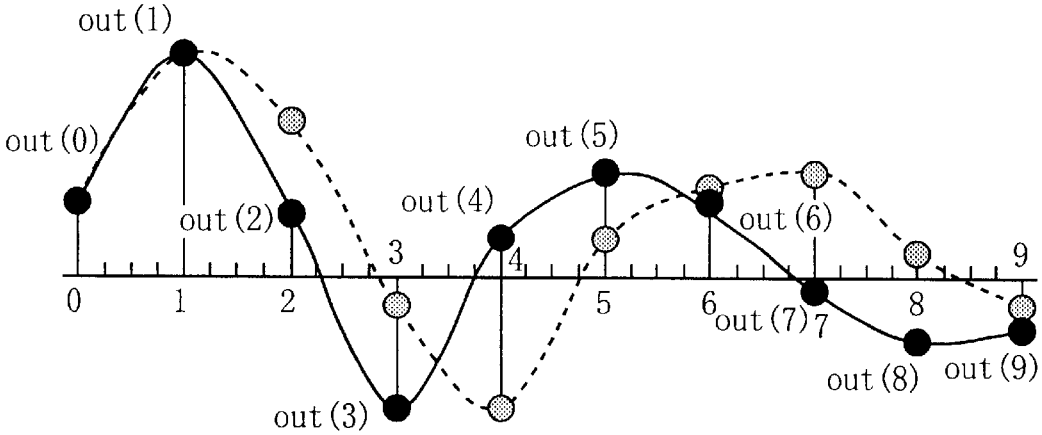
Figure 25:
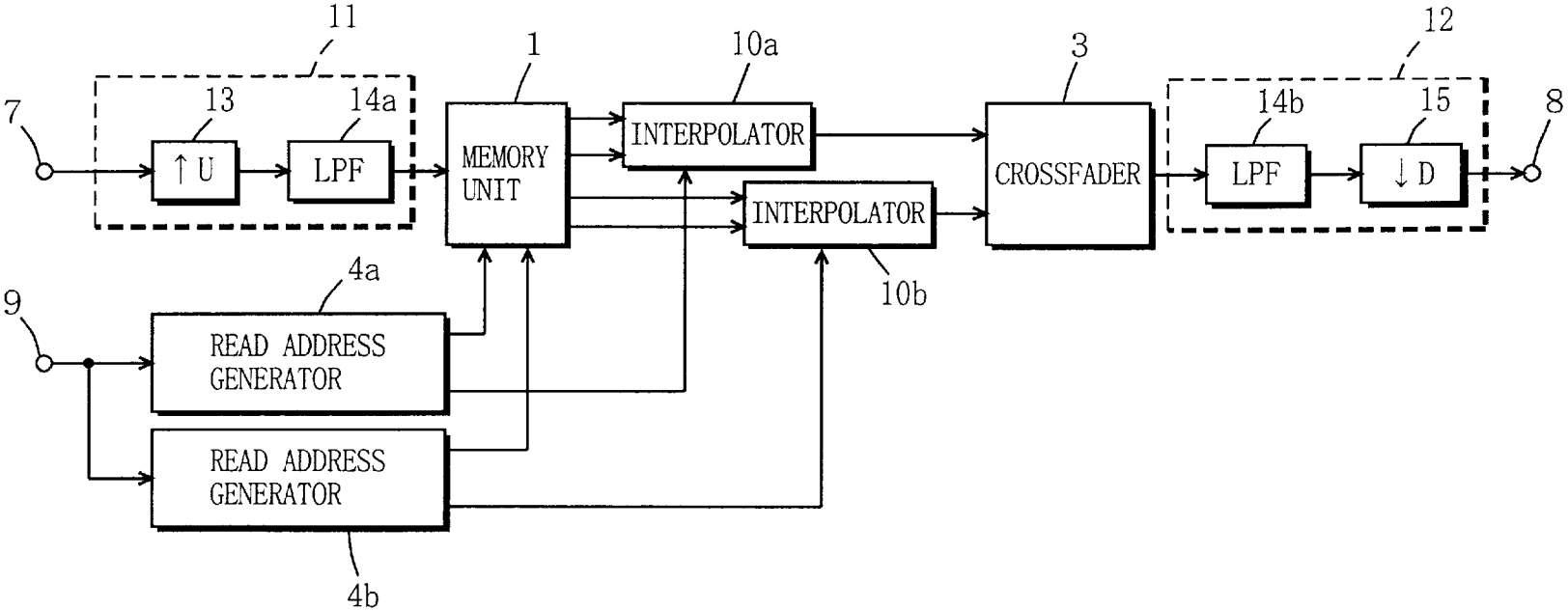
FIG. 25 PRIOR ART
FIG. 25 is a block diagram showing the structure of another conventional pitch shifter that carries out oversampling.
Figure 26A:
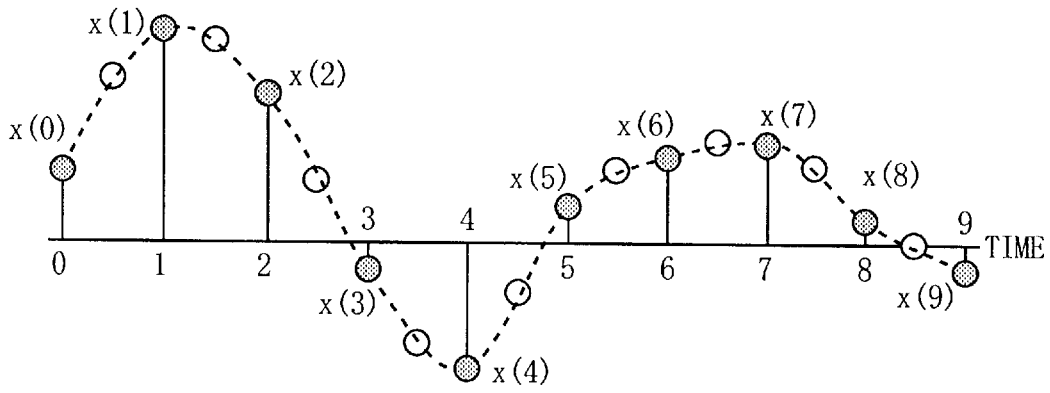
FIG. 26a PRIOR ART
FIGS. 26*a* to 26*c* are diagrams showing at a glance a pitch shifting process carried out by the pitch shifter of FIG. 25.
Figure 26B:
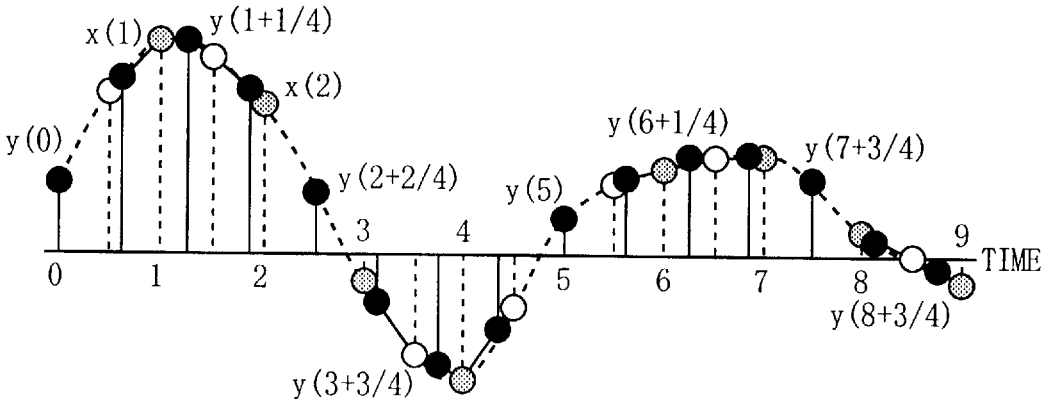
FIG. 26b PRIOR ART
Figure 26C:
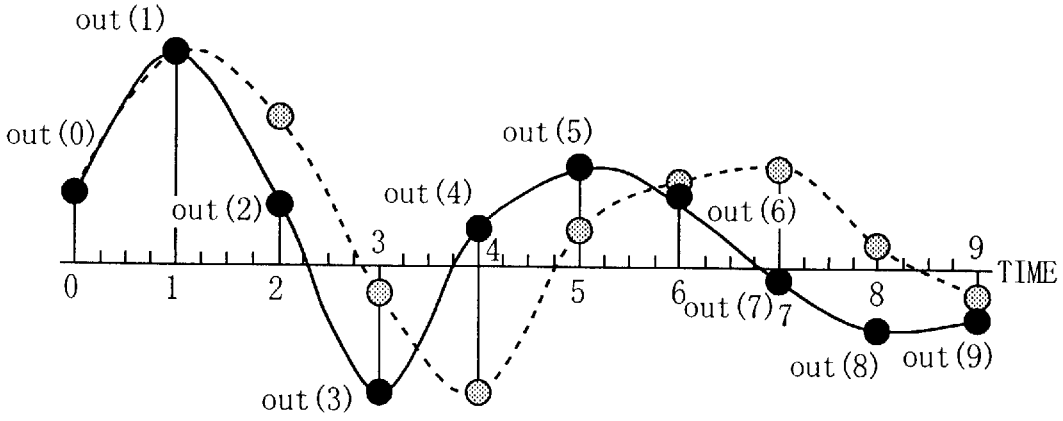
FIG. 26c PRIOR ART

FIGS. 2*a* to 2*c* is a diagram showing a relation between sound data calculated by the filter operation units 2*a* and 2*b* of the pitch shifter of FIG. 1 (where the pitch shift ratio is 1.26) and sound data produced when the oversampler 11 of the pitch shifter of FIG. 25 carries out 4-fold oversampling.

In the oversampler 11, as shown in FIG. 2*a*, three zeroes are inserted by the interpolator 13 between sound data and next sound data, such as between x(0) and x(1) and between x(1) and x (2). Then, a filter operation is carried out by the low-pass filter 14 with the following equation (4) as the filter coefficient in the cycle of $T\times4^{-1}$.

For example, after t=4, the filter operation carried out by the low-pass filter 14*a* of the oversampler 11 is as follows except multiplication by 0.

$$y(4)=f(\mathbf{0})\times(4)+f(\mathbf{4})\times(3)+f(\mathbf{8})\times(2)+f(\mathbf{12})\times(1)+f(\mathbf{16})\times(0)$$

$$y(\mathbf{4}+1/4)=f(\mathbf{1})\times(4)+f(\mathbf{5})\times(3)+f(\mathbf{9})\times(2)+f(\mathbf{13})\times(1)+f(\mathbf{17})\times(0)$$

$$y(\mathbf{4}+2/4)=f(\mathbf{2})\times(4)+f(\mathbf{6})\times(3)+f(\mathbf{10})\times(2)+f(\mathbf{14})\times(1)+f(\mathbf{18})\times(0)$$

$$y(\mathbf{4}+3/4)=f(\mathbf{3})\times(4)+f(\mathbf{7})\times(3)+f(\mathbf{11})\times(2)+f(\mathbf{15})\times(1)+f(\mathbf{19})\times(0)$$

$$y(5)=f(\mathbf{0})\times(5)+f(\mathbf{4})\times(4)+f(\mathbf{8})\times(3)+f(\mathbf{12})\times(2)+f(\mathbf{16})\times(1)$$

$$y(\mathbf{5}+1/4)=f(\mathbf{1})\times(5)+f(\mathbf{5})\times(4)+f(\mathbf{9})\times(3)+f(\mathbf{13})\times(2)+f(\mathbf{17})\times(1)$$

Thus, sound data {y(0), y(0.25), y(0.5), y(0.75), y(1), y(1.25), . . . } in a sampling cycle ($T\times4^{-1}$) is outputted from the oversampler 11.

However, if the frequency is increased by 1.26 times, for example, all of such sound data are not required.

Therefore, in the pitch shifter according to the first embodiment, any one of four sub-filters (which will be described later) is used for filter operation in the cycle T. Thus, as shown in FIG. 2*b*, only the sound data {y(0), y(1.25×1), y(1.25×2), . . . } is calculated.

Referring back to FIG. 1, the sound data input terminal 7 is provided with sound data {x(0), x(1), x(2), x(3), . . . } outputted from the sound data output terminal of the CD player. The memory unit 1 temporarily stores the sound data.

The pitch control signal input terminal 9 is provided with a pitch control signal outputted from the pitch control signal output terminal 26 of the CD player. The read address generators 42*a* and 4*b* each accumulate a pitch shift ratio indicated by the pitch control signal as an address increment value, and outputs the accumulation result as a read address.

Figure 19:
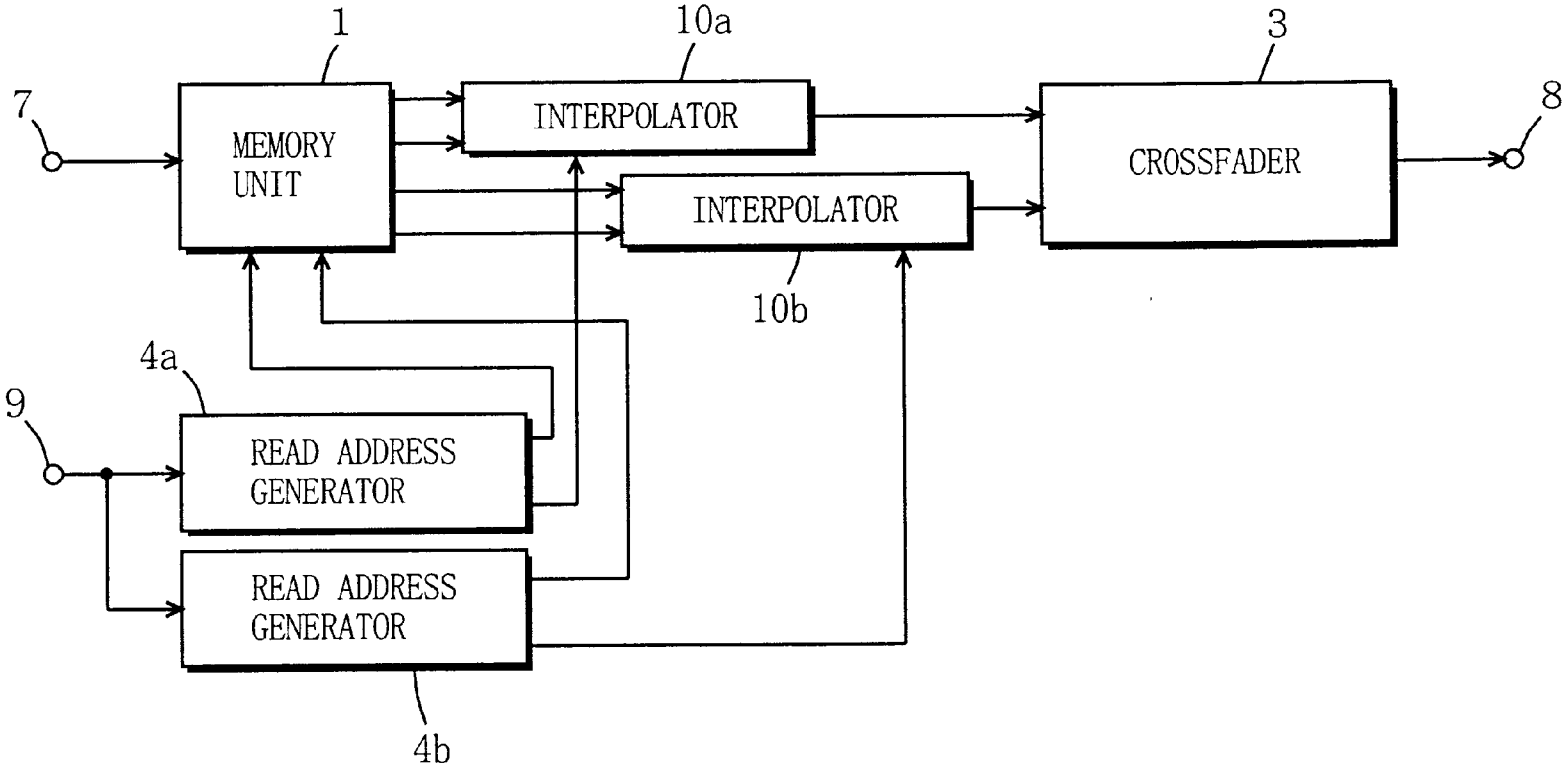
FIG. 19 PRIOR ART
FIG. 19 is a block diagram showing one example of structure of a conventional pitch shifter.

That is, the read address generators 42*a* and 4*b* each carry out the same operation as that of their counterparts shown in FIG. 19. The difference is that integer bits of the generated read address are given to the memory unit 1 as a valid read address, and the first and second bits of the decimal part (where N=4) are given to the filter coefficient string selectors 5*a* and 5*b* as filter selection information.

Note that, in general, the first to ($\log_2$N) bits of the decimal part is given to the filter coefficient string selectors 5*a* and 5*b* as filter selection information.

Figure 3:
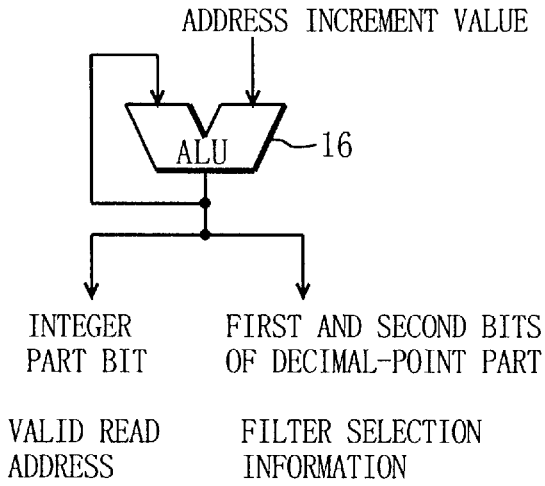
FIG. 3 is a block diagram showing one example of structure of a read address generator 4*a* or 4*b* of FIG. 1.
Figure 21:
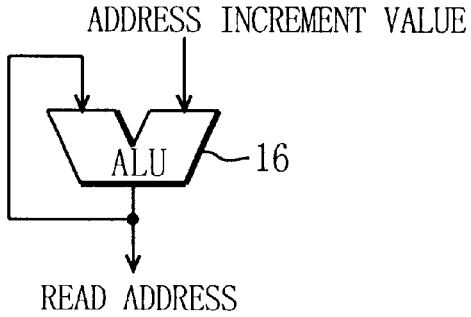
FIG. 21 PRIOR ART
FIG. 21 is a block diagram showing one example of structure of the read address generator 4*a* or 4*b* of FIG. 19.

In one example of structure shown in FIG. 3, the read address generator 4*a* or 4*b* includes, as their counterparts shown in FIG. 21, an accumulator (ALU) 16 for accumulating an address increment value k.

Figure 4:
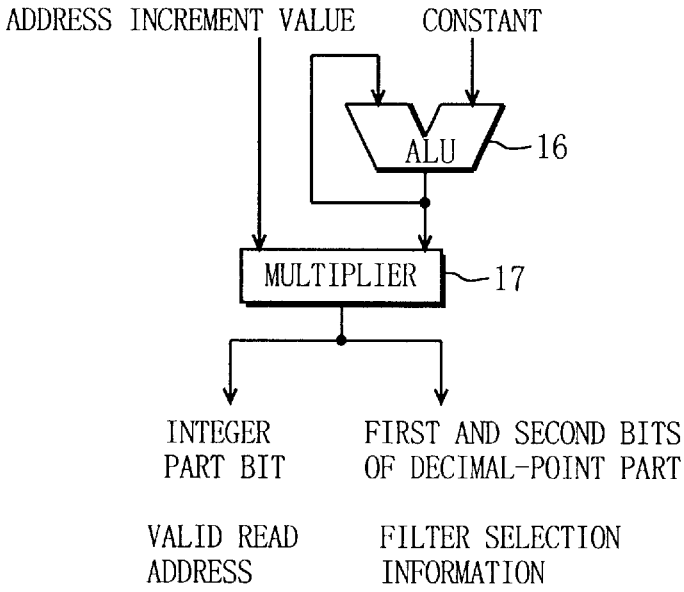
FIG. 4 is a block diagram showing another example of structure of the read address generator 4*a* or 4*b* of FIG. 1.

In another example of structure shown in FIG. 4, the read address generator 4*a* or 4*b* includes an ALU for accumulating a constant (1, for example), and a multiplier 17 for multiplying an output from the ALU by the address increment value k. The read address generator shown in this example is different in structure from that of FIG. 21, but generates the same read address.

Figure 5:
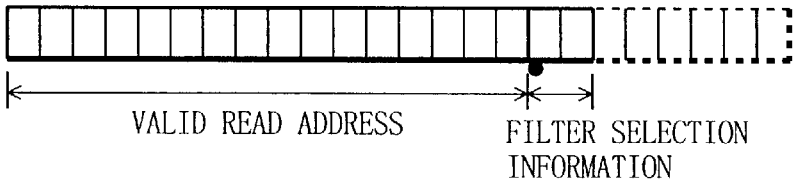
FIG. 5 is a schematic diagram showing one example of an output register (24 bits, for example) of an ALU of FIG. 3 or 4.
Figure 6A:
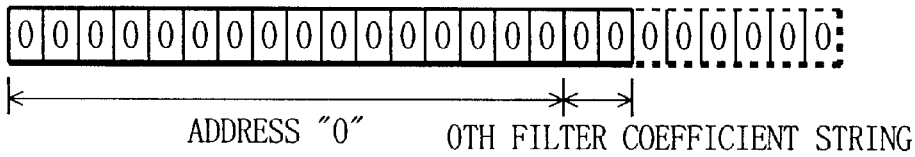
FIGS. 6*a*–6*f* is a diagram showing at a glance how read addresses are represented in the output register of FIG. 5.
Figure 6B:
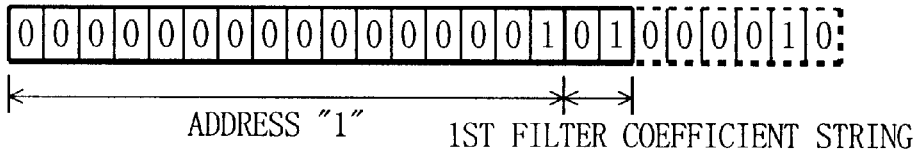
Figure 6C:
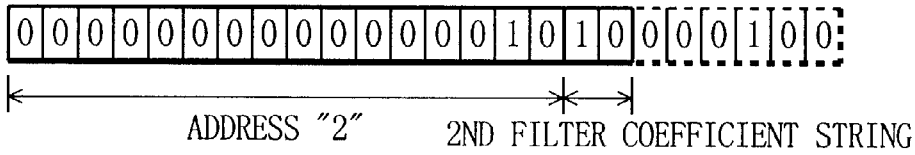
Figure 6D:
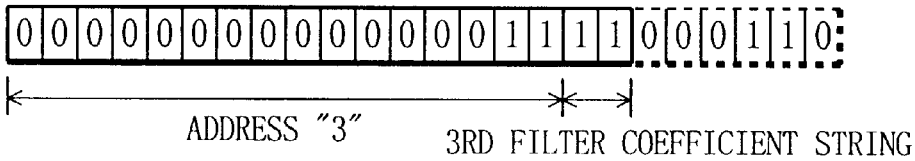
Figure 6E:
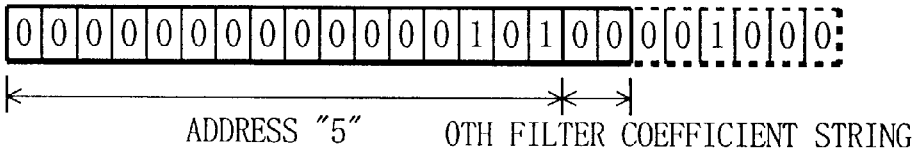
Figure 6F:
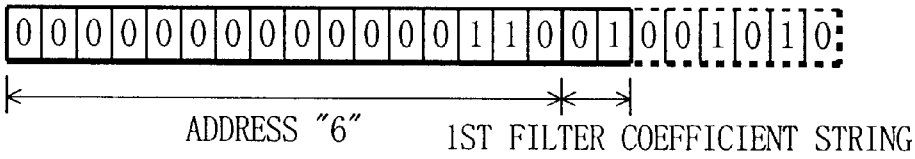

FIG. 5 is a schematic diagram showing one example of an output register (24 bits) of the ALU of FIG. 3 or 4.

In the output register shown in FIG. 5, a decimal point is located between the 16th and 17th bits from the left. It is assumed that 16 bits that are higher in order than the decimal point represent an integer part, while 8 bits that are lower in order than the decimal point represent a decimal part.

The bit located to the right of the decimal point is hereinafter referred to as "the first bit of the decimal part", and the bit located to the right to the first bit is as "the second bit of the decimal part". In this case, if N=4, for example, the first and second bits of the decimal part become the filter selection information.

Note that the relation between the read address generators 4*a* and 4*b* is the same as that of FIG. 19, and therefore is not described herein.

Referring back to FIG. 1, the memory unit 1 reads sound data strings from the buffer based on the integer parts (high-order bits) of the read addresses generated by the read address generators 4*a* and 4*b*.

In the filter coefficient string storage 6, four (N, in general) filter coefficient strings are stored. These filter coefficient strings are for four (N, in general) sub-filters produced by polyphase decomposition of the low-pass filter 14*a* included in the oversampler 11 of FIG. 25.

When N=4, the low-pass filter 14*a* included in the oversampler 11 is represented by the following equation (4), where the number of taps is 20.

$$F(z)=f(0)+f(1)z\hat{}(-1/4)+f(2)z\hat{}(-2/4)+\ldots+f(19)z\hat{}(-19/4) \quad (4)$$

Note that z^(−n) in the above equation (4) is a delay operator, and the following equation (5) holds in relation to x(t).

$$x(t)z\hat{}(-n)=x(t-n) \quad (5)$$

The four sub-filters produced through polyphase decomposition of the low-pass filter 14*a* represented by the above equation (4) are represented as the following equations (6-1) though (6-4).

$$F0(z)=f(0)+f(4)z\hat{}(-1)+f(8)z\hat{}(-2)+f(12)z\hat{}(-3)+f(16)z\hat{}(-4) \quad (6\text{-}1)$$

$$F1(z)=[f(1)+f(5)z\hat{}(-1)+f(9)z\hat{}(-2)+f(13)z\hat{}(-3)+f(17)z\hat{}(-4)]z\hat{}(-1/4) \quad (6\text{-}2)$$

$$F2(z)=[f(2)+f(6)z\hat{}(-1)+f(10)z\hat{}(-2)+f(14)z\hat{}(-3)+f(18)z\hat{}(-4)]z\hat{}(-2/4) \quad (6\text{-}3)$$

$$F3(z)=[f(3)+f(7)z\hat{}(-1)+f(11)z\hat{}(-2)+f(15)z\hat{}(-3)+f(19)z\hat{}(-4)]z\hat{}(-3/4) \quad (6\text{-}4)$$

Stored in the filter coefficient string storage 6 are coefficient parts of four (N) sub-filters produced in the above manner.

The filter coefficient string selectors 5*a* and 5*b* each select any one of four (N) filter coefficient strings stored in the filter coefficient string storage 6. This selection is made based on the first and second bits of the decimal part of the read address generated by each of the read address generators 4*a* and 4*b*. Then, the filter coefficient string selectors 5*a* and 5*b* each read the selected filter coefficient string to the filter operation units 2*a* and 2*b*, respectively.

The filter operation units 2*a* and 2*b* each carry out an filter operation based on the sound data string and the filter coefficient string from the filter coefficient string selectors 5*a* and 5*b*, respectively.

The crossfader 3 receives the sound data from the filter operation units 2*a* and 2*b*, and carries out crossfading on these paired sound data. That is, each data is multiplied by a crossfading coefficient, and then added together.

Note that, with the crossfader 3 further provided, the pitch shifter can shift an acoustic signal in pitch to an arbitrary level, which is similar to the conventional pitch shifter.

From the sound data output terminal 8, the sound data after crossfading compression/extension, that is, after shifted in pitch, is outputted.

The operation of the above-structured pitch shifter is described below. Note that the operation of the CD player is similar to that as described in the Background Art section.

Figure 20:
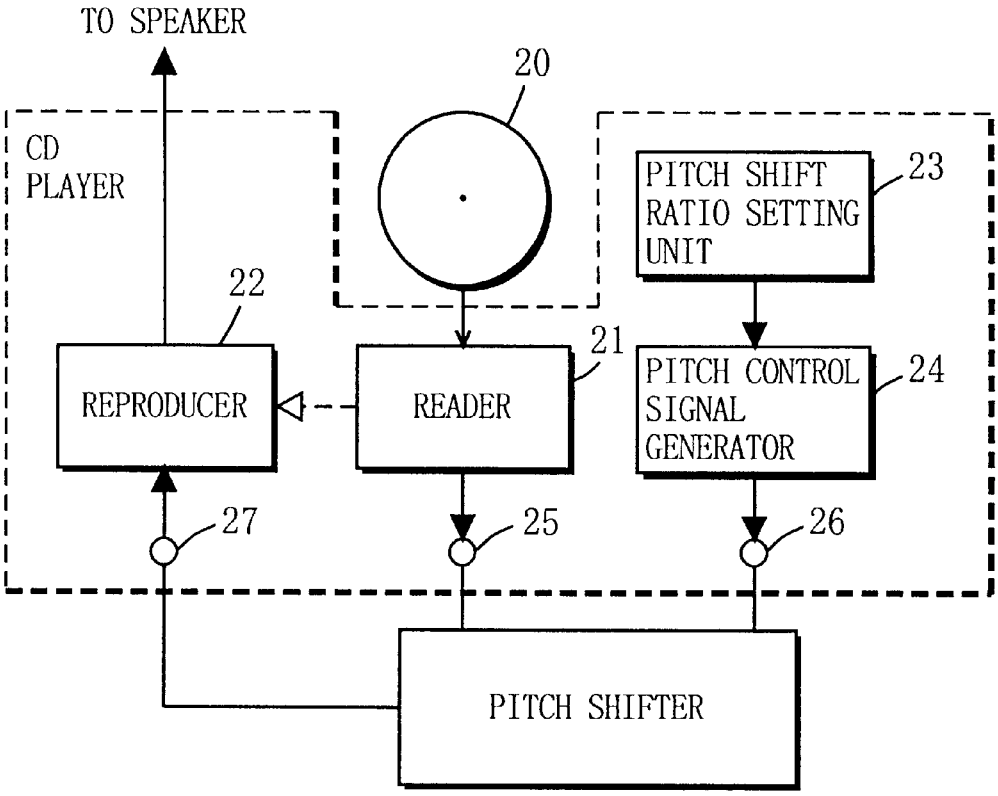
FIG. 20 PRIOR ART
FIG. 20 is a block diagram showing one example of structure of a conventional CD player equipped with the pitch shifter of FIG. 19.

In FIG. 20, the user first specifies, through the adjustment control not shown, a desired pitch shift ratio k, and then presses a PLAY button (not shown) provided thereon.

In response, in the CD player, the pitch shift ratio setting unit 23 first sets the pitch shift ratio k therein. Then, the reader 21 starts to read the sound data from the CD 20 in the cycle T. Also, the pitch shift ratio setting unit 23 starts to generate a pitch control signal indicating the pitch shift ratio k. Note that the pitch shift ratio k set in the above manner may be shifted to another value after the start of reproduction.

Thus read sound data and the generated pitch control signal are provided to the pitch shifter of FIG. 1 through the sound data input terminal 7 and the sound control signal input terminal 9.

Figure 22A:
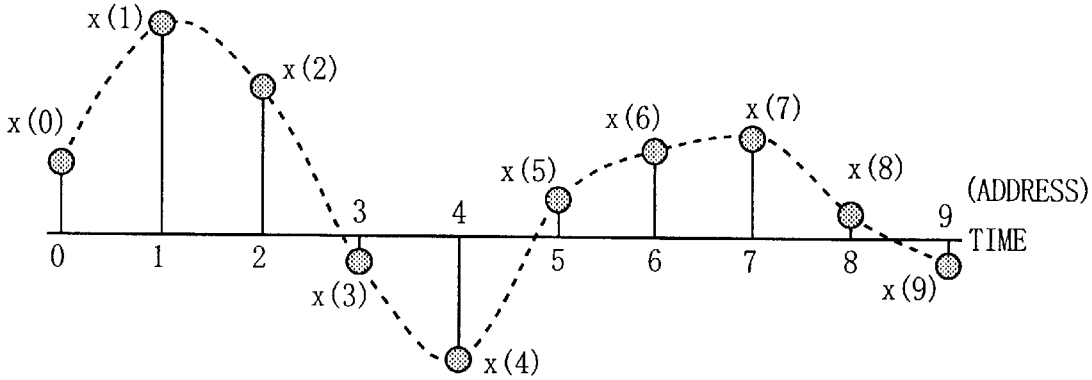
FIG. 22a PRIOR ART
FIGS. 22*a* to 22*c* are diagrams showing a pitch shifting process carried out by the pitch shifter of FIG. 19.
Figure 22B:
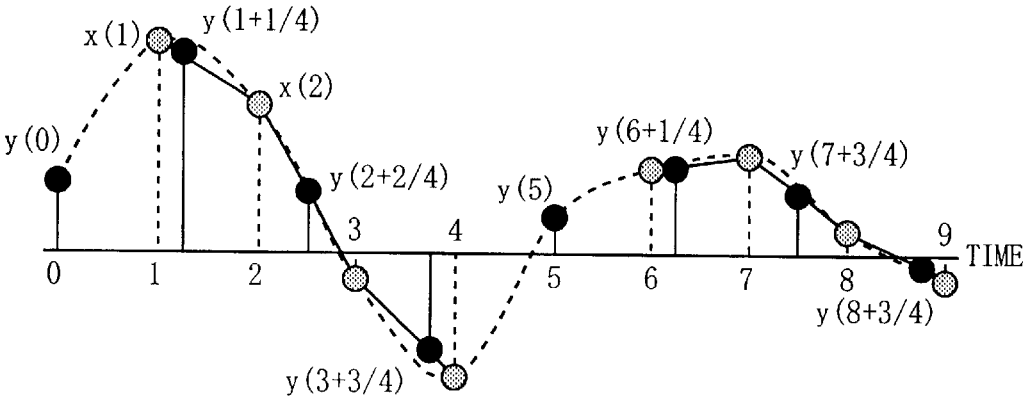
FIG. 22b PRIOR ART
Figure 22C:
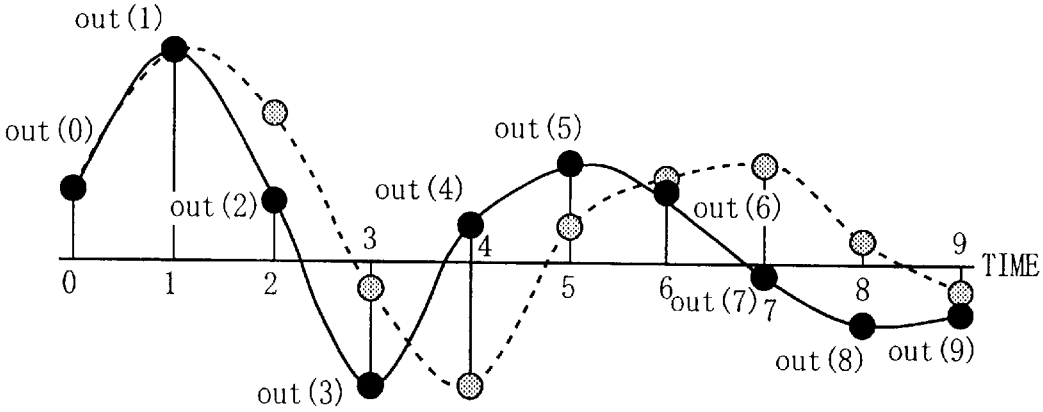
FIG. 22c PRIOR ART

The provided sound data is temporarily stored in the memory unit 1. How the memory unit 1 stores the sound data is shown in FIG. 22*a*. That is, the memory unit 1 stores the provided sound data in sequence, such as x(0) in address 0, x(1) in address 1, and x(2) in address 2.

On the other hand, the provided pitch control signal is branched into two, and given to the read address generators 4*a* and 4*b*. Based on the given sound control signal, the read address generators 4*a* and 4*b* each generate a read address differed from each other by a predetermined value in the cycle T.

The generated paired read addresses are given to the memory unit 1 and the filter coefficient string selectors 5*a* and 5*b*.

More specifically, the integer bits of the read address generated by the read address generator 4*a* is given to the memory unit 1 as a valid read address, while the first and second bits of the decimal part thereof are given to the filter coefficient string selector 5*a* as the filter selection information. Similarly, the integer bits of the read address generated by the read address generator 4*b* is given to the memory unit 1 as a valid read address, while the first and second bits of the decimal part thereof are given to the filter coefficient string selector 5*b* as the filter selection information.

The memory unit 1 reads paired sound data strings from the buffer based on the given paired integer-part bits (valid read addresses).

Figure 23:
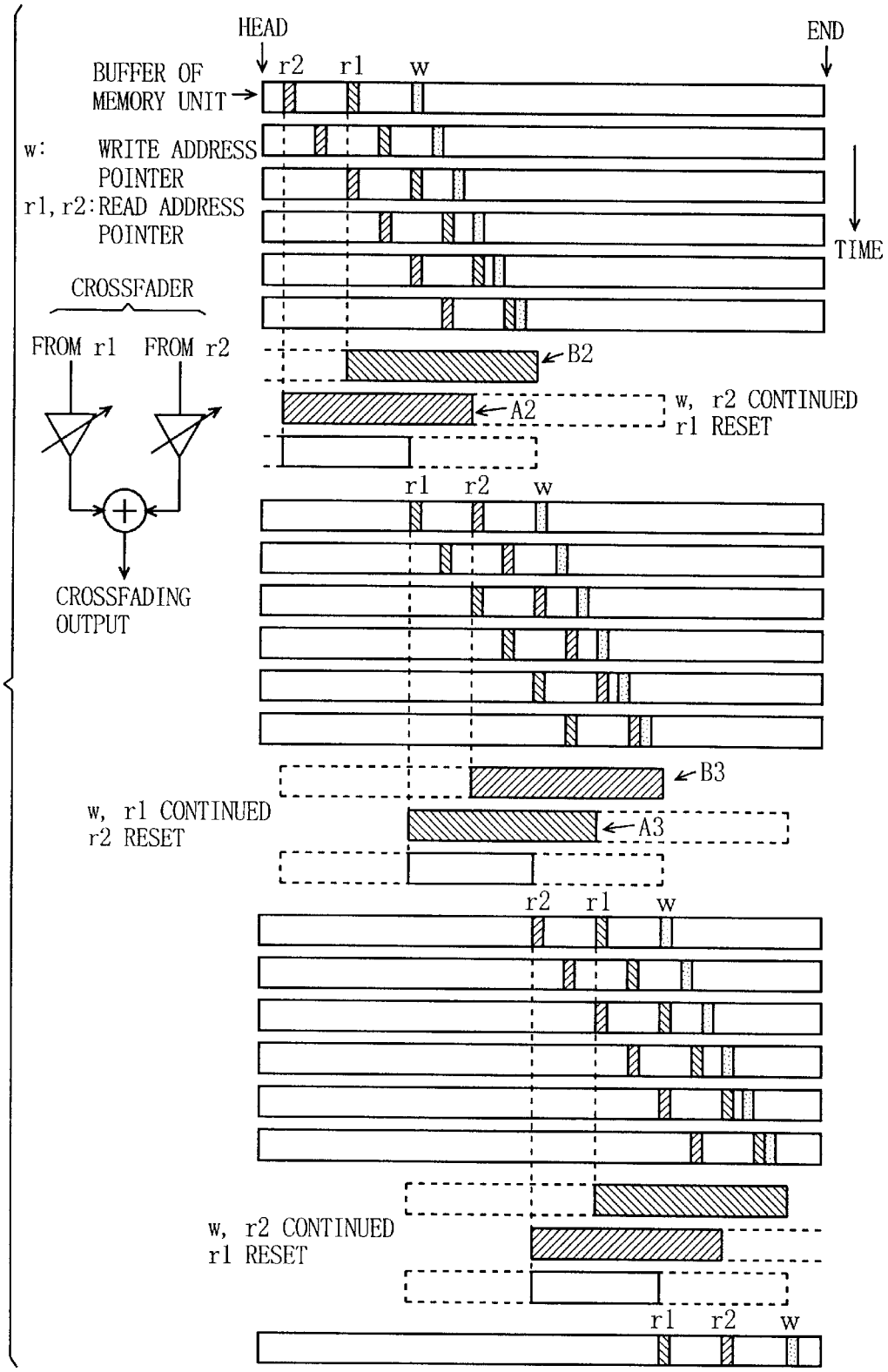
FIG. 23 PRIOR ART
FIG. 23 is a diagram showing a relation, on a buffer of the memory unit 1 of FIG. 19, between a position to which inputted sound data is written and two positions from which previously-written sound data is read based on the addresses from the paired address generators 4*a* and 4*b*, where the pitch is shifted higher.

FIG. 23 shows a relation, on the buffer of the memory unit 1, between a position to which the inputted sound data is written and two positions from which paired sound data strings are read based on the valid read addresses from the paired read address generators 4*a* and 4*b*. In this case, however, the read address pointers "r1" and "r2" each point the head of the data string to be read.

How the memory unit 1 writes the inputted sound data in the buffer and reads the paired sound data from the buffer based on the given paired valid read addresses are similar to that as described in the Background Art section, except that what is read is sound data strings composed of five pieces of sound data (where N=4).

On the other hand, the filter coefficient string selectors 5*a* and 5*b* select, based on the given paired filter selection information, any one of N filter coefficient strings stored in the filter coefficient string storage 6. Then, the filter coefficient string selectors 5*a* and 5*b* read the selected filter coefficient string to the filter operation units 2*a* and 2*b*, respectively.

For example, when N=4 and the number of taps are 20, the following four filter coefficient strings are sequentially stored in the filter coefficient string storage 6.

{f(0), f(4), f(8), f(12), f(16)}
{f(1), f(5), f(9), f(13), f(17)}
{f(2), f(6), f(10), f(14), f(18)}
{f(3), f(7), f(11), f(15), f(19)}

Hereinafter, the above filter coefficient strings are referred to as, from the above, a 0th filter coefficient string, a 1st filter coefficient string, a 2nd filter coefficient string, and a 3rd filter coefficient string.

The filter coefficient string selectors 5*a* and 5*b* each select a filter in the following manner, based on the given filter selection information.

When the filter selection information is "00", select the 0th filter coefficient string.

When the filter selection information is "01", select the 1st filter coefficient string.

When the filter selection information is "10", select the 2nd filter coefficient string.

When the filter selection information is "11", select the 3rd filter coefficient string.

The filter operation units 2*a* and 2*b* carry out the filter operation based on the sound data string (composed of five pieces of sound data, in this example) from the memory unit 1 and the filter coefficient string from the filter coefficient string selectors 5*a* and 5*b*, respectively. Then, the filter operation units 2*a* and 2*b* each calculate t he required sound data {y(0), y(k×1), y(k×2), . . . }.

Here, as a specific example, the operations of the read address generators 4*a* and 4*b*, the filter coefficient string selector 5*a* and 5*b*, and the filter operation units 2*a* and 2*b* are described where the pitch shift ratio is 1.26.

From the read address generators 4*a* and 4*b*, such read addresses are sequentially generated in the cycle T.

$t$=0:0

$t$=1:1.26=1+¼+0.01

$t$=2:1.26×2=2+⅔+0.02

$t$=3:1.26×3=3+¾+0.03

$t$=4:1.26×4=5+0.04

$t$=5:1.26×5=6+¼+0.05

$t$=6:1.26×6=7+⅔+0.06

$t$=7:1.26×7=8+¾+0.07

$t$=8:1.26×8=10+0.08

$t$=9:1.26×9=11+¼+0.09

The above read addresses are represented in the output register of FIG. 5 as follows.

t=0:0000000000000000.00000000
t=1:0000000000000001.01000010
t=2:0000000000000010.10000100
t=3:0000000000000011.11000110
t=4:0000000000000101.00001000
t=5:0000000000000110.01001010
t=6:0000000000000111.10001100
t=7:0000000000001000.11001110
t=8:0000000000001010.00010000
t=9:0000000000001011.01010010

The first to sixteenth bits of the integer part of the read address are given to the memory unit 1 as the valid address, while the first and second bits of the decimal part of the read address are given to the filter coefficient string selectors 5*a* and 5*b* as the filter selection information (refer to FIG. 6).

In response, the memory unit 1 sequentially reads, in the cycle T, a set of five pieces of successive sound data with its head corresponding to the given valid read address, and then provides the read sound data to the filter operation units 2*a* and 2*b*. Therefore, the sound data read from the memory unit 1 and provided to the filter operation units 2*a* and 2*b* after time t=4 are as follows.

t=4:{x(5), x(4), x(3), x(2), x(1)}
t=5:{x(6), x(5), x(4), x(3), x(2)}
t=6:{x(7), x(6), x(5), x(4), x(3)}
t=7:{x(8), x(7), x(6), x(5), x(4)}
t=8:{x(10), x(9), x(8), x(7), x(6)}
t=9:{x(11), x(10), x(9), x(8), x(7)}

On the other hand, the filter coefficient string selectors 5*a* and 5*b* each select a filter in the following manner based on the given filter selection information after the time t=4.

t=4: Select the 0th filter coefficient string based on the filter information "00"

t=5: Select the 1st filter coefficient string based on the filter information "01"

t=6: Select the 2nd filter coefficient string based on the filter information "10"

t=7: Select the 3rd filter coefficient string based on the filter information "11"

t=8: Select the 0th filter coefficient string based on the filter information "00"

t=9: Select the 1st filter coefficient string based on the filter information "01"

The filter operation units 2*a* and 2*b* carry out the following filter operation based on the sound data from the memory unit 1 and the filter coefficient strings from the filter coefficient string selectors 5*a* and 5*b*, respectively, after the time t=4.

$$t=4:\ Y(1.25\times4)=f(0)x(5)+f(4)x(4)+f(8)x(3)+f(12)x(2)+f(16)x(1)$$

$$t=5:\ Y(1.25\times5)=f(1)x(6)+f(5)x(5)+f(9)x(4)+f(13)x(3)+f(17)x(2)$$

$$t=6:\ Y(1.25\times6)=f(2)x(7)+f(6)x(6)+f(10)x(5)+f(14)x(4)+f(18)x(3)$$

$$t=7:\ Y(1.25\times7)=f(3)x(8)+f(7)x(7)+f(11)x(6)+f(15)x(5)+f(19)x(4)$$

$$t=8:\ Y(1.25\times8)=f(0)x(10)+f(4)x(9)+f(8)x(8)+f(12)x(7)+f(16)x(6)$$

$$t=9:\ Y(1.25\times9)=f(1)x(11)+f(5)x(10)+f(9)x(9)+f(13)x(8)+f(17)x(7)$$

Thus produced sound data { . . . , y(1.25×4), y(1.25×5), y(1.25×6), y(1.25×7), y(1.25×8), y(1.25×9), . . . }is equivalent to the sound data produced through 4-fold oversampling, and a good approximate value to the ideal value {x(1.26×4), x(1.26×5), x(1.26×6), x(1.26×7), x(1.26×8), x(1.26×9), . . . }. The larger, the oversampling ratio N is, the more the sound data becomes close to the ideal value.

The operations of the read address generators 4*a* and 4*b*, the filter coefficient string selectors 5*a* and 5*b*, and the filter operation units 2*a* and 2*b* are now briefly summarized below.

Figure 7:
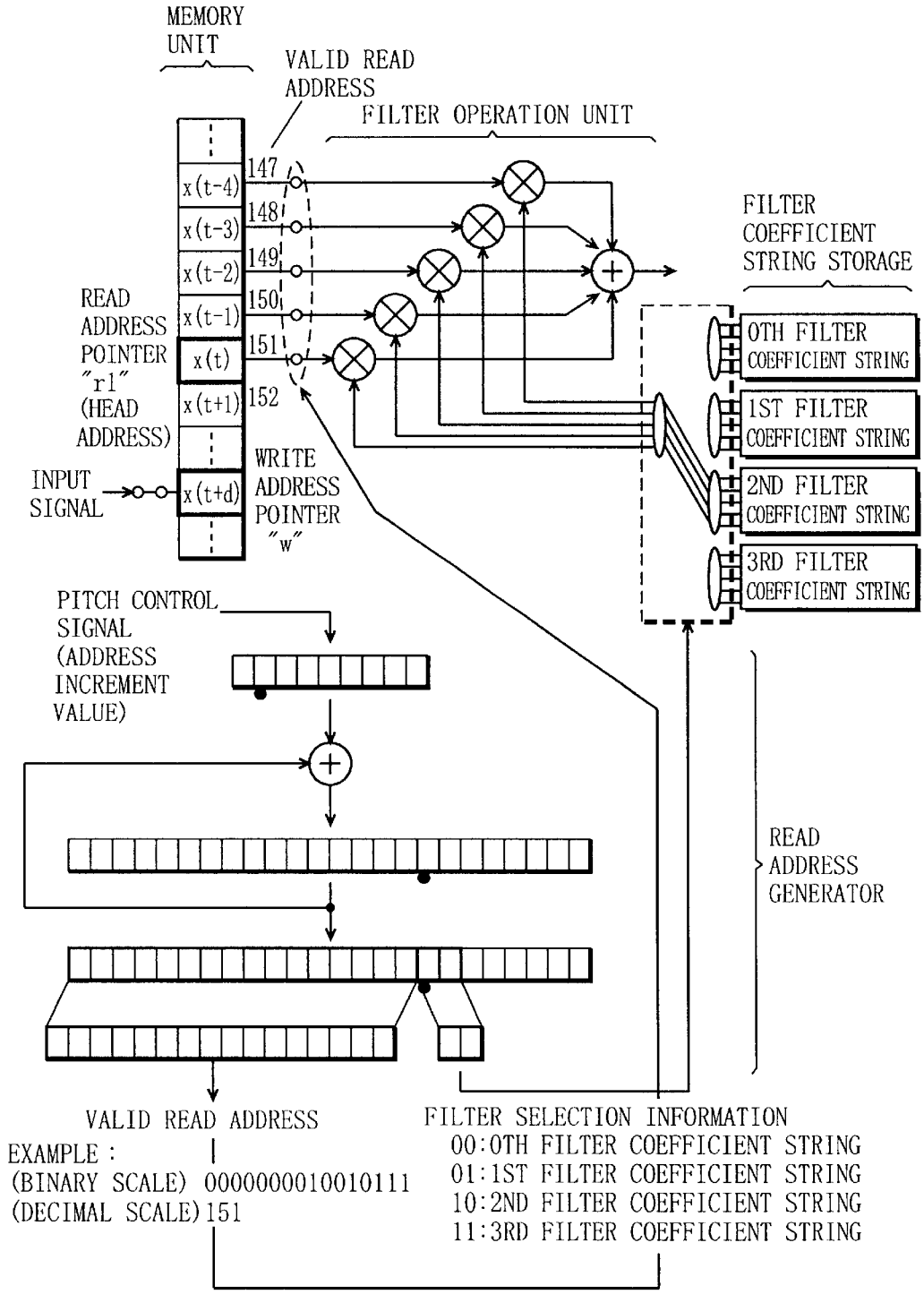
FIG. 7 is a schematic diagram showing at a glance a pitch shifting operation carried out by the pitch shifter of FIG. 1.

FIG. 7 is a schematic diagram showing at a glace the pitch shifting operation carried out by the pitch shifter of FIG. 1.

In FIG. 7, now assume that the read address generator 4*a* generates a read address "0000000010010111.10 . . . ". At this time, the valid read address corresponds its integer part "0000000010010111", that is, "151" in decimal notation. The filter selection information corresponds its first and second bits of the decimal part "10" in binary notation.

On receiving the read address, the memory unit 1 reads a sound data string (five pieces of sound data) from addresses of 151 to 147 of the buffer. On receiving the filter selection information, the filter coefficient string selector 5*a* selects the 3rd filter coefficient string.

Then, the read sound data string and the selected filter coefficient string are given to the filter operation unit 2*a*, and the filter operation is carried out therein.

The similar operation is carried out by the read address generator 4*b*, the filter coefficient string selector 5*b*, and the filter operation 2*b*.

Referring back to FIG. 1, paired sound data differed from each other by a predetermined time are outputted from the filter operation units 2*a* and 2*b* to the crossfader 3. The crossfader 3 carries out crossfading on the sound data. This crossfading is similar to that described in the Background Art section.

Figure 24:
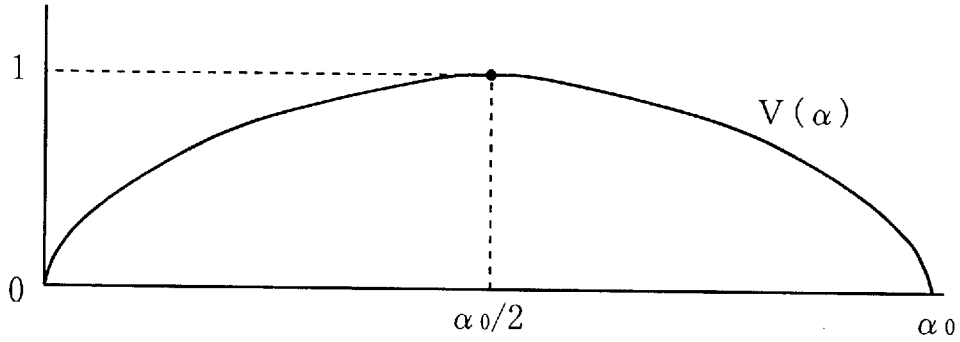
FIG. 24 PRIOR ART
FIG. 24 is a diagram showing one example of paired crossfading coefficient by which the crossfader 3 of FIG. 19 multiplies paired sound data.

More specifically, the crossfader 3 stores in advance paired crossfading coefficients by which the paired sound data are multiplied, such as those shown in FIG. 24.

The crossfader 3 detects the position of the paired sound data in frame from the head by counting the number of paired sound data provided thereto. For example, for $n_1$ and $n_2$ sound data, paired V ($\alpha$) corresponding to $\alpha=n_1$ and $n_2$ are calculated. Then, each sound data is multiplied by its corresponding V ($\alpha$) and the multiplication results are added together.

Then, the addition result, that is, the sound data after shifted in pitch, {y'(0), y'(1.25×1), y'(1.25×2), . . . } (in general, {y'(0), y'(k×1), y'(k×2), . . . 1}) is outputted in the cycle T to the outside of the pitch shifter through the sound data output terminal 8.

The sound data after shifted in pitch {y' (0), y'(k×1), y'(k×2) . . . } outputted from the pitch shifter is again provided to the CD player through the sound data input terminal 27.

In FIG. 20, the sound data after shifted in pitch provided through the sound data input terminal 27 is given to the reproducer 22. The reproducer 22 reproduces the acoustic signal from the provided sound data after shifted in pitch.

The acoustic signal reproduced in the above-described manner is amplified through an amplifier (not shown), and then provided to the speaker, and converted into an acoustic wave.

FIG. 2*c* is a diagram showing at a glance the acoustic signal reproduced from the sound data after shifted in pitch.

In FIG. 2*c*, {out(0), out(1), out(2), . . . } is an acoustic signal that corresponds to the sound data after shifted in pitch {y'(0), y'(k×1), y'(k×2), . . . }. The horizontal axis represents real time t by a unit of the cycle T.

(Second Embodiment)

In a second embodiment, the pitch shifter according to the first embodiment further carries out linear interpolation, thereby enabling pitch shift with high accuracy even if the oversampling ratio is small. The principle of linear interpolation is the same as that already described in the Background Art section. However, the difference is that a pitch shifter according to the second embodiment calculates an interpolation value by using the sound data produced through filter operation, that is, the sound data after oversampling. For example, to calculate an interpolation value y(1.26), the conventional pitch shifter uses the sound data x(1) and x(2), while the pitch shifter according to the second embodiment uses the sound data after oversampling y(1.25) and y(1.5).

Moreover, as an interpolation coefficient for linear interpolation, the $\{(\log_2 N)+1\}$-th or lower bits of the decimal part of the read address are used. Therefore, linear interpolation is easily carried out without increase in size of the pitch shifter.

Figure 8:
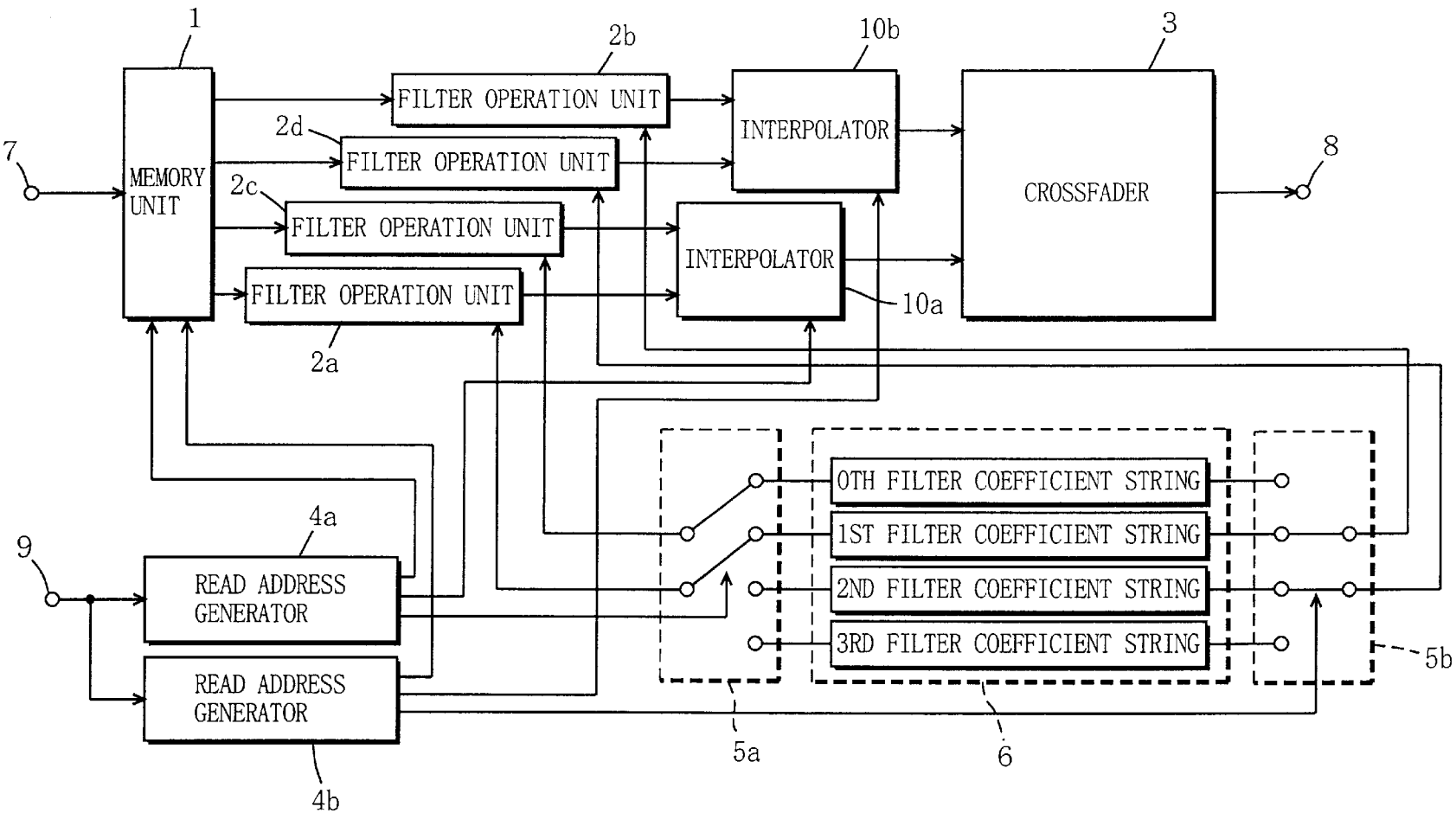
FIG. 8 is a block diagram showing the structure of a pitch shifter according to a second embodiment of the present invention.

FIG. 8 is a block diagram showing the structure of the pitch shifter according to the second embodiment of the present invention.

The pitch shifter according to the second embodiment is provided, for example, to the conventional CD player as shown in FIG. 20.

In FIG. 8, the pitch shifter according to the second embodiment includes the memory unit 1, paired filter operation units 2*a* and 2*b*, other paired filter operation units 2*c* and 2*d*, the paired interpolators 10*a* and 10*b*, the crossfader 3, the paired read address generators 4*a* and 4*b*, the paired filter coefficient string selectors 5*a* and 5*b*, the filter coefficient string storage 6, the sound data input terminal 7, the sound data output terminal 8, and the sound control signal input terminal 9. Note that the components that are identical to those in the conventional pitch shifter (refer to FIG. 19) and the pitch shifter according to the first embodiment (refer to FIG. 1) are provided with the same reference numerals.

More specifically, the pitch shifter according to the second embodiment is structured of the pitch shifter according to the first embodiment with the other paired filter operation units 2*c* and 2*d* and the paired interpolators 10*a* and 10*b* added thereto. The $\{(\log_2 N)+1\}$-th or lower bits of the decimal part of the read address generated by the read address generators 4*a* and 4*b* are provided to the paired interpolators 10*a* and 10*b* as the interpolation coefficients.

The sound data input terminal 7 is provided with sound data {x(0), x(1), x(2), x(3), . . . } outputted from the sound data output terminal of the CD player. The memory unit 1 temporarily stores the sound data.

The pitch control signal input terminal 9 is provided with a pitch control signal outputted from the pitch control signal output terminal 26 of the CD player. The read address generators 4*a* and 4*b* each accumulate a pitch shift ratio indicated by the pitch control signal as an address increment value, and outputs the accumulation result as a read address.

That is, the read address generators 4*a* and 4*b* each carry out the same operation as that of their counterparts shown in FIG. 1. Then, the integer bits of the generated read address are given to the memory unit 1 as a valid read address, and the first and second bits of the decimal part (where N=4) are given to the filter coefficient string selectors 5*a* and 5*b* as filter selection information. Note that, in general, the first to $(\log_2 N)$ bits of the decimal part is given to the filter coefficient string selectors 5*a* and 5*b* as filter selection information. This operation is similar to that of the pitch shifter according to the first embodiment.

The difference lies in the following two points. Firstly, in the present embodiment, not only the integer-part bits but also other integer bits calculated from the above integer bits and the first and second bits of the decimal part are given to the memory unit 1. Alternatively, the above integer bits and the first and second bits of the decimal part are given to the memory unit 1, and based thereon, the memory unit 1 calculates other integer-part bits. The other integer-part bits can be calculated by adding "1" to the second bit (in general, $(\log_2 N)$ bit) of the decimal part of the read address generated by the read address generators 4*a* and 4*b*, and then extracting the integer part of the addition result.

Secondly, in the present embodiment, the third or lower bits of the decimal part that are not used in the first embodiment are given to the interpolators 10*a* and 10*b*. In general, $\{(\log_2 N)+1\}$-th or lower bits of the decimal part are given to the interpolators 10*a* and 10*b*.

Figure 9:
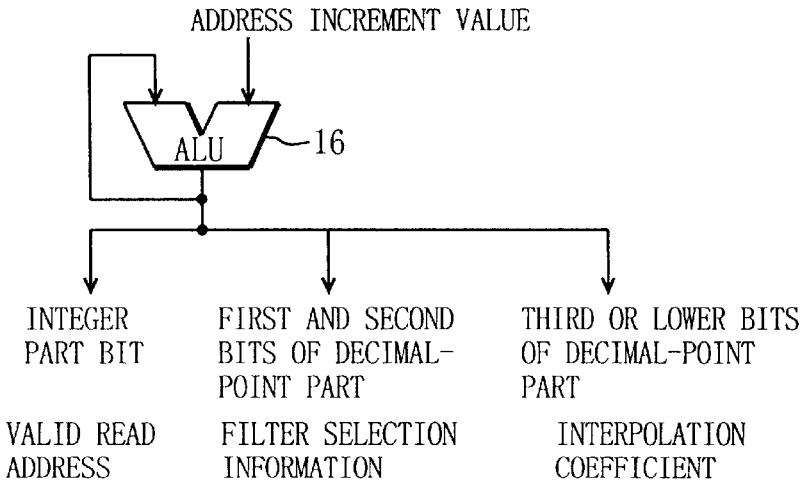
FIG. 9 is a block diagram showing one example of structure of a read address generator 4*a* or 4*b* of FIG. 8.
Figure 10:
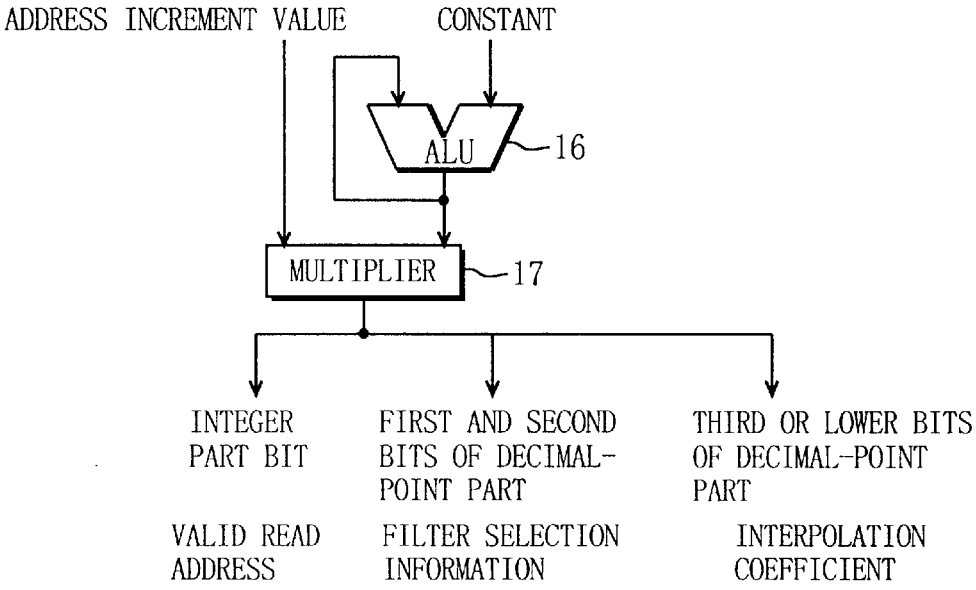
FIG. 10 is a block diagram showing another example of structure of the read address generator 4*a* or 4*b* of FIG. 8.

FIG. 9 is a block diagram showing one example of structure of the read address generator 4*a* or 4*b*. FIG. 10 is a block diagram showing another example of structure thereof.

In one example of structure shown in FIG. 9, the read address generators 4*a* and 4*b* each includes the accumulator (ALU) 16 for accumulating an address increment value k. This structure is similar to that shown in FIG.3.

In another example of structure shown in FIG. 10, the read address generator 4*a* or 4*b* includes the ALU for accumulating a constant (1, for example), and the multiplier 17 for multiplying an output from the ALU by the address increment value k. This structure is similar to that shown in FIG. 4.

Figure 11:
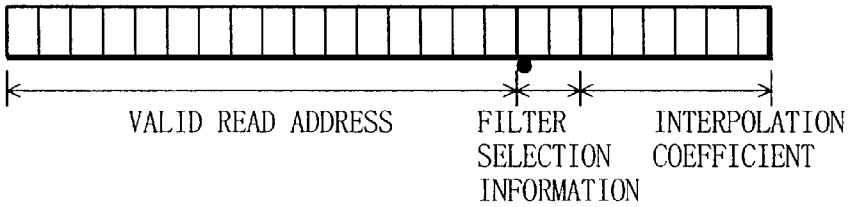
FIG. 11 is a schematic diagram showing an output register (24 bits, for example) of an ALU of FIG. 9 or 10.

FIG. 11 is a schematic diagram showing one example of an output register (24bits)of the ALU of FIG. 9 or 10.

In the output register shown in FIG. 10, when N=4, for example, the third bit of the decimal part is taken as the interpolation coefficient. In general, $\{(\log_2 N)+1\}$-th or lower bits of the decimal part is taken as the interpolation coefficient. Other than that, FIG. 11 is similar to FIG. 5.

The relation between the read address generators 4*a* and 4*b* is the same as that in the first embodiment, and thus is not described herein.

Referring back to FIG. 8, the memory unit 1 reads sound data strings from the buffer based on the integer part of the read addresses generated by the read address generators 4*a* and 4*b*.

However, for linear interpolation, the memory unit 1 reads, in addition to the paired sound data strings as those in the first embodiment, other paired sound data strings identical to each other or differed from each other in address by one. More specifically, based on the integer-part bits from the read address generator 4*a,* two sound data strings identical to each other or differed from each other in address by one are read. Similarly, based on the integer-part bits from the read address generator 4*b,* two sound data strings identical to each other or differed from each other in address by one are read. Two identical sound data strings are read when the first and second bits of the decimal part of each of the read addresses generated by the read address generators 4*a* and 4*b* represent either of "00", "01", "10". Two sound data differed from each other in address by one are read when the above first and second bits represent "11". In general, Two sound data strings differed from each other in address by one are read only when the first to $(\log_2 N)$-th bits of the decimal part all represent "1", and two identical sound data strings are read when otherwise.

In the filter coefficient string storage 6, four (N in general) filter coefficient strings are stored. These filter coefficient strings are for four (N, in general) sub-filters produced by polyphase decomposition of the low-pass filter 14*a* included in the oversampler 11 of FIG. 25.

When N=4, the low-pass filter 14*a* is represented by the above equation (4). The four sub-filters produced by polyphase decomposition of the low-pass filter 14*a* are represented by the above equations (6-1) through (6-2).

The filter coefficient string selector 5*a* selects any two filter coefficient strings adjacent to each other out of four (N) filter coefficient strings stored in the filter coefficient string storage 6. This selection is made based on the first and second bits of the decimal part of the read address generated by the read address generator 4*a*. Then, the filter coefficient string selector 5*a* reads these selected filter coefficient strings to the filter operation units 2*a* and 2*c*.

The filter coefficient string selector 5*b* selects any two filter coefficient strings adjacent to each other out of four (N) filter coefficient strings stored in the filter coefficient string storage 6. This selection is made based on the first and second bits of the decimal part of the read address generated by the read address generator 4*b*. Then, the filter coefficient string selector 5*b* reads these selected filter coefficient strings to the filter operation units 2*b* and 2*d*.

The filter operation units 2*a* and 2*c* each carry out the filter operation based on the sound data from the memory unit 1 and the filter coefficient strings from the filter coefficient string selector 5*a*. The filter operation units 2*b* and 2*d* each carry out the filter operation based on the sound data from the memory unit 1 and the filter coefficient strings from the filter coefficient string selector 5*b*.

The interpolator 10*a* calculates, through the above equation (3), an interpolation value based on the paired sound data from the filter operation units 2*a* and 2*c* and the interpolation coefficients (that is, the third through eighth bits of the read address) from the read address generator 4*a*. The interpolator 10*b* calculates, through the above equation (3), an interpolation value based on the paired sound data from the filter operation units 2*b* and 2*d* and the interpolation coefficients (that is, the third through eighth bits of the read address) from the read address generator 4*b*.

The crossfader 3 receives interpolated sound data outputted from the interpolator 10*a* and interpolated sound data outputted from the interpolator 10*b,* and carries out crossfading thereon. That is, each sound data is multiplied by a crossfading coefficient, and then added together.

From the sound data output terminal 8, sound data after subjected to crossfading compression/extension, that is, sound data after shifted in pitch, is outputted.

The operation of the above-structured pitch shifter is described below. However, the operation similar to that of the pitch shifter according to the first embodiment is not described herein or briefly described, and only the different operation is described.

In FIG. 20, the sound data read from the CD 20 and the pitch control signal indicating the pitch shift ratio k are provided through the sound data input terminal 7 and the pitch control signal input terminal 9 to the pitch shifter.

The inputted sound data is temporarily stored in the memory unit 1. How the memory unit 1 stores the sound data is shown in FIG. 22*a*.

On the other hand, the inputted pitch control signal is branched into two, and given to the read address generators 4*a* and 4*b*. Based on the given sound control signal, the read address generators 4*a* and 4*b* each generate a read address differed from each other by a predetermined value in the cycle T.

The generated paired read addresses are given to the memory unit 1, the paired filter coefficient string selectors 5*a* and 5*b,* and the paired interpolators 10*a* and 10*b*.

That is, the integer-part bits of the bit string of the read address generated by the read address generator 4*a* are read to the memory unit 1 as the valid read address. The first and second bits of the decimal part are given to the filter coefficient string selector 5*a* as the filter selection information. The first and second bits of the decimal part are also given to the memory unit 1, and the third to eighth bits thereof to the interpolator 10*a*.

The integer-part bits of the bit string of the read address generated by the read address generator 4*b* is given to the memory unit 1 as the valid read address, while the first and second bits of the decimal part thereof to the filter coefficient string selector 5*b* as the filter selection information, and further to the memory unit 1. The third through eighth bits of the decimal part are given to the interpolator 10*b*.

The memory unit 1 reads paired sound data strings from the buffer in a similar manner to that in the first embodiment, based on the given paired integer-part bits (valid read address). In addition, the memory unit 1 calculates other paired integer-part bits from the given paired integer-part bits and the first and second bits of the decimal part. Then, based on the other paired integer-part bits, the memory unit 1 further reads other paired sound data identical to each other or differed from each other in address b one.

Note that, in FIG. 23, shown is the relation, on the buffer in the memory unit 1, between "w" indicating a position to which the inputted sound data is written, and "r1" and "r2" each indicating a position from which paired sound data strings are read based on the paired read address generators 4*a* and 4*b,* respectively, where the pitch is shifted higher. To apply the relation shown in FIG. 23 to the present embodiment, "r3" is added at the same position as that of "r1", and "r4" is added at the same position as that of "r2". However, in some cases, "r3" is temporarily shifted rearward by one address from "r1" (to right, in the drawing), and "r4" is temporarily shifted rearward (to right, in the drawing) by one address from "r2".

On the other hand, the filter coefficient string selector 5*a* selects two adjacent filter coefficient strings from four (N, in general) filter coefficient strings stored in the filter coefficient string storage 6. This selection is made based on the given paired filter selection information. Then, the filter coefficient string selector 5*a* reads the selected filter coefficient strings to the filter operation units 2*a* and 2*c*. Similarly, the filter coefficient string selector 5*b* selects two adjacent filter coefficient strings from four (N, in general) filter coefficient strings stored in the filter coefficient string storage 6. This selection is made based on the given paired filter selection information. Then, the filter coefficient string selector 5*b* reads the selected filter coefficient strings to the filter operation units 2*b* and 2*d*.

For example, when N=4, the 0th to 3rd filter coefficient strings are stored in the filter coefficient string storage 6, as in the first embodiment.

In this case, the filter coefficient string selector 5*a* carries out filter selection based on the given filter selection information as the following manner.

When the filter selection information is "00", the filter coefficient string selector 5*a* selects the 0th and 1st filter coefficient strings corresponding to "00" and "01", and then provides the selected 0th and 1st filter coefficient strings to the filter operation units 2*a* and 2*c*, respectively.

When the filter selection information is "01", the filter coefficient string selector 5*a* selects the 1st and 2nd filter coefficient strings corresponding to "01" and "10", and then provides the selected 1st and 2nd filter coefficient strings to the filter operation units 2*a* and 2*c*, respectively.

When the filter selection information is "10", the filter coefficient string selector 5*a* selects the 2nd and 3rd filter coefficient strings corresponding to "10" and "11", and then provides the selected 2nd and 3rd filter coefficient strings to the filter operation units 2*a* and 2*c*, respectively.

When the filter selection information is "11", the filter coefficient string selector 5*a* selects the 3rd and 0th filter coefficient strings corresponding to "11" and "00", and then provides the selected 3rd and 0th filter coefficient strings to the filter operation units 2*a* and 2*c*, respectively.

On the other hand, the filter coefficient string selector 5*b* carries out filter selection based on the given filter selection information as the following manner.

When the filter selection information is "00", the filter coefficient string selector 5*b* selects the 0th and 1st filter coefficient strings corresponding to "00" and "01", and then provides the selected 0th and 1st filter coefficient strings to the filter operation units 2*b* and 2*d*, respectively.

When the filter selection information is "01", the filter coefficient string selector 5*b* selects the 1st and 2nd filter coefficient strings corresponding to "01" and "10", and then provides the selected 1st and 2nd filter coefficient strings to the filter operation units 2*b* and 2*d*, respectively.

When the filter selection information is "10", the filter coefficient string selector 5*b* selects the 2nd and 3rd filter coefficient strings corresponding to "10" and "11", and then provides the selected 2nd and 3rd filter coefficient strings to the filter operation units 2*b* and 2*d*, respectively.

When the filter selection information is "11", the filter coefficient string selector 5*b* selects the 3rd and 0th filter coefficient strings corresponding to "11" and "00", and then provides the selected 3rd and 4th filter coefficient strings to the filter operation units 2*b* and 2*d*, respectively.

The filter operation units 2*a* and 2*b* carry out a filter operation based on the paired sound data strings from the memory unit 1 and the paired filter coefficient strings from the filter coefficient string selectors 5*a* and 5*b*, respectively. Similarly, The filter operation units 2*c* and 2*d* carry out a filter operation based on the other paired sound data strings from the memory unit 1 and the paired filter coefficient strings from the filter coefficient string selectors 5*a* and 5*b*, respectively. Each filter operation is similar to that in the first embodiment.

The interpolator 10*a* calculates an interpolation value q(1.26×n) by using the following equation (7), based on the sound data y(m) and y(m+¼) from the filter operation units 2*a* and 2*c* and interpolation information (the third to eighth bits of the decimal part) from the read address generator 4*a*. The interpolator 10*b* calculates an interpolation value q(1.26×n) by using the following equation (7), based on the sound data y(m) and y(m+¼) from the filter operation units 2*b* and 2*d* and interpolation information (the third to eighth bits of the decimal part) from the read address generator 4*b*.

$$q(1.26\times n)=y(m)+(1.26\times n-m)\times\{y(m+¼)-y(m)\} \quad (7)$$

Here, m is a maximum multiple of (¼) not more than 1.26. The interpolation coefficient (1.26×n−m) is calculated by inserting a decimal point between the third and fourth bits of the decimal part of the interpolation information (the third to eighth bits of the decimal part).

For example, when t=3, the read address is 1.26×3, that is, 00000000000000011.11000110

(refer to the first embodiment). From the read address generator 4*a*, the third to eighth bits of the decimal point of this read address "000110" is provided to the interpolator 10*a* as the interpolation information. Also, form the filter operation units 2*a* and 2*c*, y(3.75) and y(4.00) are provided to the interpolator 10*a*.

In response, the interpolator 10*a* inserts the decimal point between the third and fourth bits of the decimal part in the provided third to eighth bits "000110". Then, from the produced interpolation coefficient "0.00110(binary notation)" and the sound data y(3.75) and y(4.00), the interpolator 10 calculates the interpolation value q(1.26 3) by using the above equation (7).

In general, when the read address is (k×n), the interpolator 10*a* and 10*b* calculates interpolation value q(k×n) from a interpolation coefficient (k×n−m) and sound data y(m) and y(m+1/N) by using the following equation (8).

$$q(k\times n)=y(m)+(k\times n-m)\times\{y(m+1/N)-y(m)\} \quad (8)$$

By further carrying out such linear interpolation, the pitch shifter according to the present embodiment can achieve pitch shift with higher accuracy than that in the first embodiment.

The paired sound data differed in time by predetermined time are sequentially outputted in the cycle T from the interpolator 10*a* and 10*b* to the crossfader 3. The crossfader 3 carries out crossfading on these sound data. This crossfading is similar to that in the first embodiment.

More specifically, the crossfader 3 stores in advance paired crossfading coefficients by which the interpolated paired sound data are multiplied, as shown in FIG. 24, for example.

The crossfader 3 detects the position of the interpolated pair of sound data in frame from the head by counting the number of interpolated paired sound data provided thereto. For example, for $n_1$ and $n_2$ interpolated sound data, paired $V(\alpha)$ corresponding to $\alpha=n_1$ and $n_2$ are calculated. Then, each sound data is multiplied by its corresponding $V(\alpha)$ and the multiplication results are added together.

Then, the addition result, that is, the sound data after shifted in pitch, $\{q'(0), q'(k\times1), q'(k\times2), \ldots\}$ is outputted in the cycle T to the outside of the pitch shifter through the sound data output terminal 8.

The sound data after shifted in pitch $\{q'(0), q'(k\times1)\ q'(k\times2), \ldots\}$ outputted from the pitch shifter is again provided to the CD player through the sound data input terminal 27.

In FIG. 20, the sound data after shifted in pitch provided through the sound data input terminal 27 is given to the reproducer 22. The reproducer 22 reproduces the acoustic signal from the provided sound data after shifted in pitch.

The acoustic signal reproduced in the above-described manner is amplified through an amplifier (not shown), and then provided to the speaker, and then converted into an acoustic wave.

(Third Embodiment)

FIG. 12 is a block diagram showing the structure of a pitch shifter according to a third embodiment of the present invention.

The pitch shifter according to the second embodiment is provided, for example, to the conventional CD player as shown in FIG. 20.

In FIG. 12, the pitch shifter according to the third embodiment includes the memory unit 1, the filter operation unit 2*a,* the crossfader 3, the read address generator 4*a,* the filter coefficient string selector 5*a,* the filter coefficient string storage 6, the sound data input terminal 7, the sound data output terminal 8, and the sound control signal input terminal 9. Note that the components that are identical to those of the pitch shifter according to the first embodiment (refer to FIG. 1) are provided with the same reference numerals.

That is, the pitch shifter according to the third embodiment is structured by the pitch shifter according to the first embodiment (refer to FIG. 1) with the read address generator 4*b,* the filter coefficient string selector 5*b,* and the filter operation unit 2*b* omitted therefrom, and further with the filter operation unit 2*a* and the crossfader 3 interchanged in order.

The components except the memory unit 1 and the crossfader 3 operate similarly to their counterparts in the first embodiment.

Figure 13:
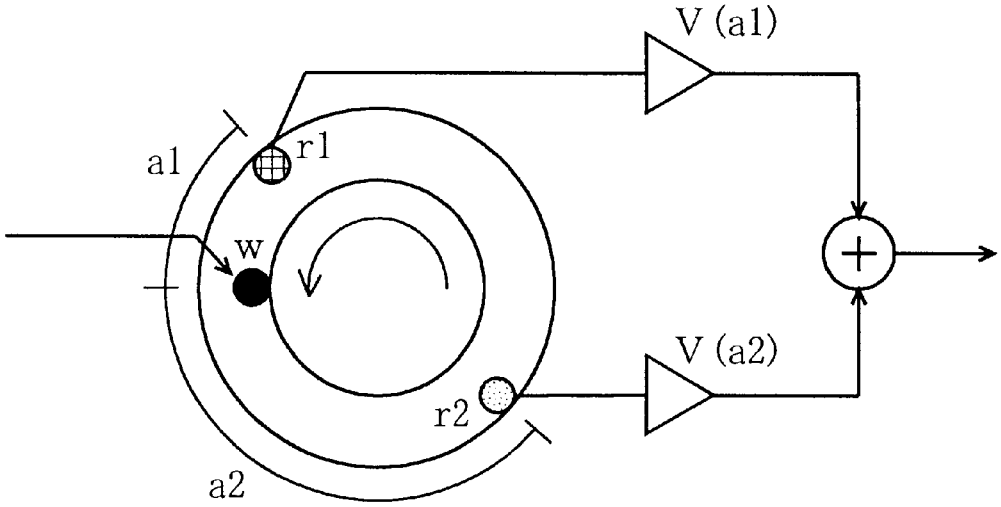
FIG. 13 is a diagram schematically showing an internal structure of a memory unit 1 and a crossfader 3 of FIG. 12.

FIG. 13 is a schematic diagram showing an internal structure of the memory unit 1 and the crossfader 3 of FIG. 12.

In FIG. 13, the buffer included in the memory unit 1 is a ring buffer with its head and end of a storage area connected to each other like a ring. The capacity of this ring buffer is equivalent to the distance twice as long as the distance between read address pointers "r1" and "r2".

Here, assume the capacity of the ring buffer in the memory unit 1 is 4096 words. Therefore, in the memory unit 1, if the head of the ring buffer is at an address 0 and the end thereof is at an address 4095, these addresses are successive, that is, the address 4095 is followed by the address 0.

On the ring buffer, a write address pointer "w" proceeds at predetermined speed in the direction indicated by an arrow in FIG. 13. "w" proceeds by one address in a unit time (sampling cycle T) irrespectively of k.

On the other hand, the read address pointers "r1" and "r2" keeps a positional relation as opposed to each other on the ring buffer, and proceed at k (=pitch shift ratio) times faster than the speed of "w" in the direction indicated by the arrow.

In this case, the relation between the read address pointers "r1" and "r2" as represented by the following equation (9) holds.

$$r2=r1+2048(0\leqq r1<2048),\ r2=r1-2048(2048\leqq r1<4096) \tag{9}$$

Therefore, the memory unit 1 calculates r2 by using the above equation (9) based on the read address r1 from the read address generator 4*a,* thereby reading the same paired sound data as that in the first embodiment.

Attention should be given to the following two points.

Firstly, since there is the relation between the paired read addresses r1 and r2 as represented by the above equation (9), the memory unit can read the same paired sound data as that in the first embodiment if either one of r1 and r2 is known.

Secondly, since r1 and r2 are different in decimal part, it is not required to individually select the filter coefficient string used in filter operation for each of r1 and r2. Furthermore, the filter operation and crossfading are executed as interchanged in order, and therefore these operation do not have to be executed for each of r1 and r2 individually.

In view of these points, the pitch shifter according to the third embodiment is structured as described above. That is, the present pitch shifter is structured by the pitch shifter according to the first embodiment (refer to FIG. 1) with the read address generator 4*b,* the filter coefficient string selector 5*b,* and the filter operation unit 2*b* omitted therefrom, and further with the filter operation unit 2*a* and the crossfader 3 interchanged in order.

Furthermore, on the ring buffer, the write address pointer "w" internally divides an arc between the read address pointers "r1" and "r2" (2048 words of length) into a1 and a2.

That is, a1 represents the difference between the write address "w" and the read address "r1", while a3 represents the difference between the write address "w" and the read address "r2". a1 and a2 satisfy the following equation (10).

$$a1+a2=2048 \tag{10}$$

At this time, the crossfader 3 previously stores paired crossfading coefficients V(a1) and V(a2) by which the paired sound data read from the memory unit 1 are multiplied.

Figure 14:
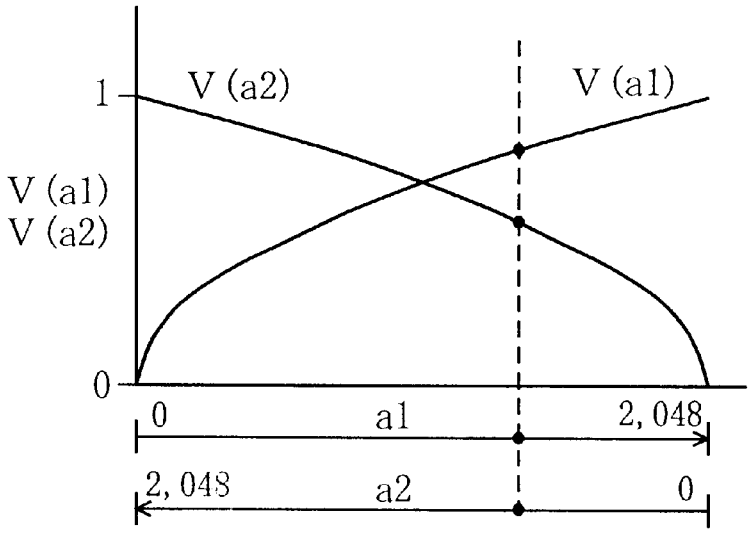
FIG. 14 is a diagram showing one example of paired crossfading coefficients V(a1) and V(a2) by which the crossfader 3 multiplies the pair of sound data read from the memory unit 1.

FIG. 14 shows one example of such paired crossfading coefficients V(a1) and V(a2).

Since a1 and a2 have the relation as represented by the above equation (10), only one of a1 and a2 is to be known. Therefore, as shown in FIG. 14, the crossfader 3 stores in advance V(a1) and V(a2) when the a1 (or a2) is 0 to 2048. Then, the crossfader 3 calculates a1 from the read address r1 from the read address generator 4*a* and the write address w, selects V(a1) and V(a2) that correspond to a1, and then multiplies the paired sound data read from the memory unit 1 by the selected V(a1) and V(a2).

The operation of the above-structured pitch shifter is described below. However, the operation similar to that of the pitch shifter according to the first embodiment is omitted or briefly described herein, and the different operation is described in detail.

In FIG. 20, the sound data read from the CD 20 and the pitch control signal indicating the pitch shift ratio k are provided through the sound data input terminal 7 and the pitch control signal input terminal 9 to the pitch shifter.

The inputted sound data is temporarily stored in the memory unit 1. How the memory unit 1 stores the sound data is shown in FIG. 22*a*.

On the other hand, the inputted pitch control signal is given to the read address generator. Based on the given sound control signal, the read address generator 4*a* generates a read address in the cycle T. This read address is the same as that in the first embodiment.

The generated read address is given to the memory unit 1, the paired filter coefficient string selector 5*a*.

That is, the integer-part bits of the bit string of the read address generated by the read address generator 4*a* are read to the memory unit 1 as the valid read address. The first and second bits of the decimal part are given to the filter coefficient string selector 5*a* as the filter selection information.

Based on the given integer-part bits (valid read address r1), the memory unit 1 reads the sound data from the buffer.

That is, the memory unit calculates the other address r2 based on r1 by using the above equation (9), and read paired sound data from the addresses corresponding to r1 and r2.

Figure 15:
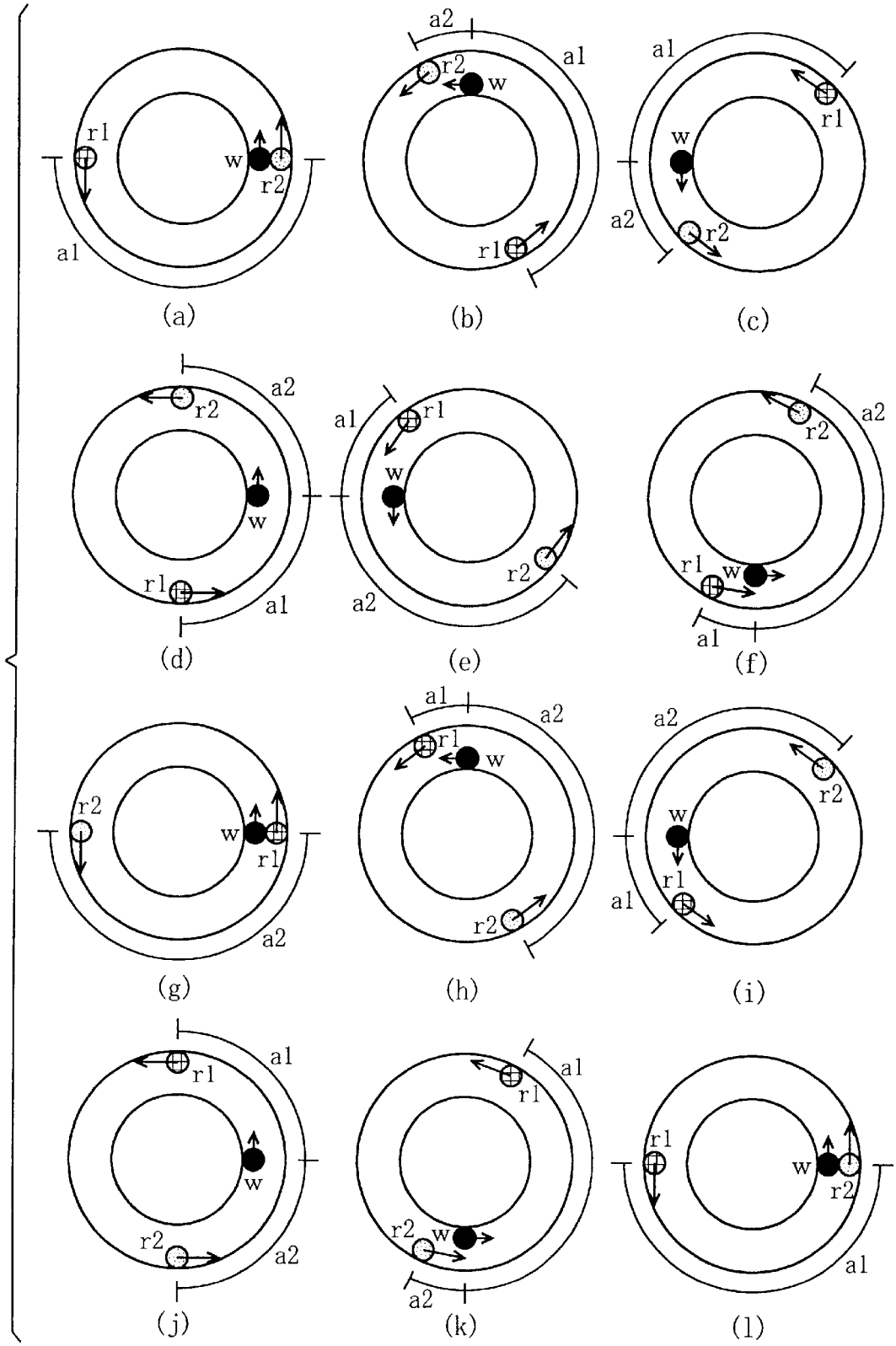
FIG. 15 is a diagram schematically showing a relation between a position to which inputted sound data is written (write address pointer "w") and two positions from which the paired sound data are read based on the addresses given by the read address generator 4*a* (read address pointers "r1" and "r2"), where the pitch is shifted higher.
Figure 16A:
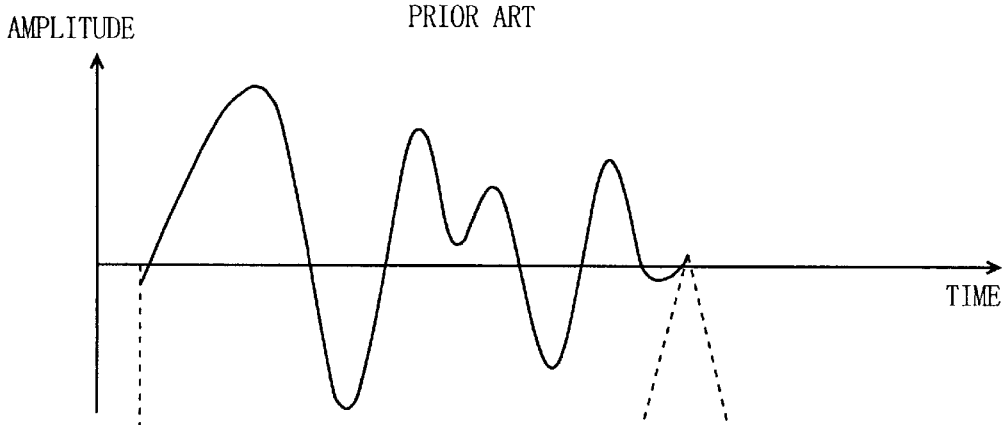
FIG. 16a PRIOR ART
FIGS. 16*a* to 16*c* are diagrams in assistance of explaining the principle of shifting an acoustic signal in pitch to a desired level.
Figure 16B:
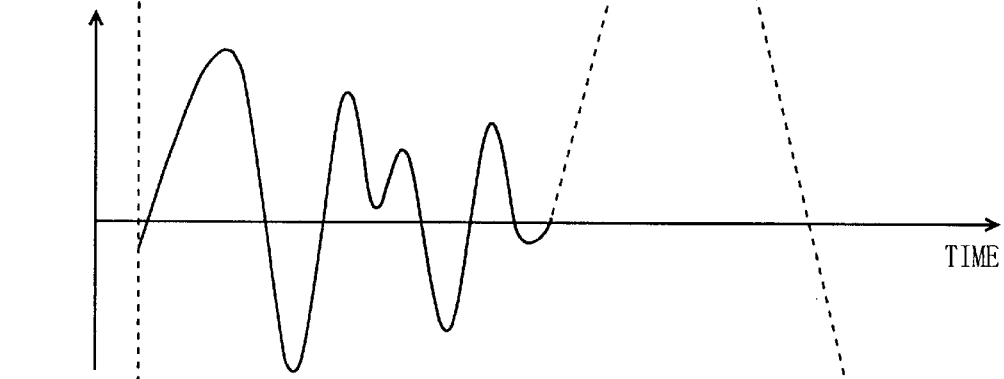
FIG. 16b PRIOR ART
Figure 16C:
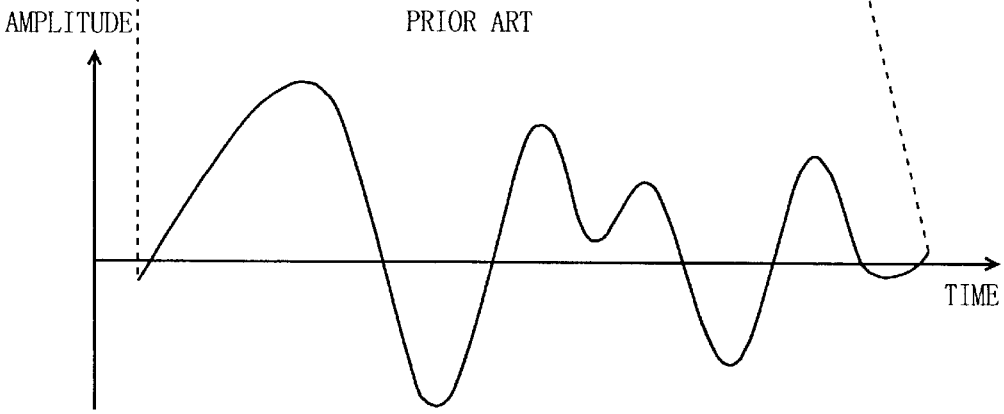
FIG. 16c PRIOR ART
Figure 17:
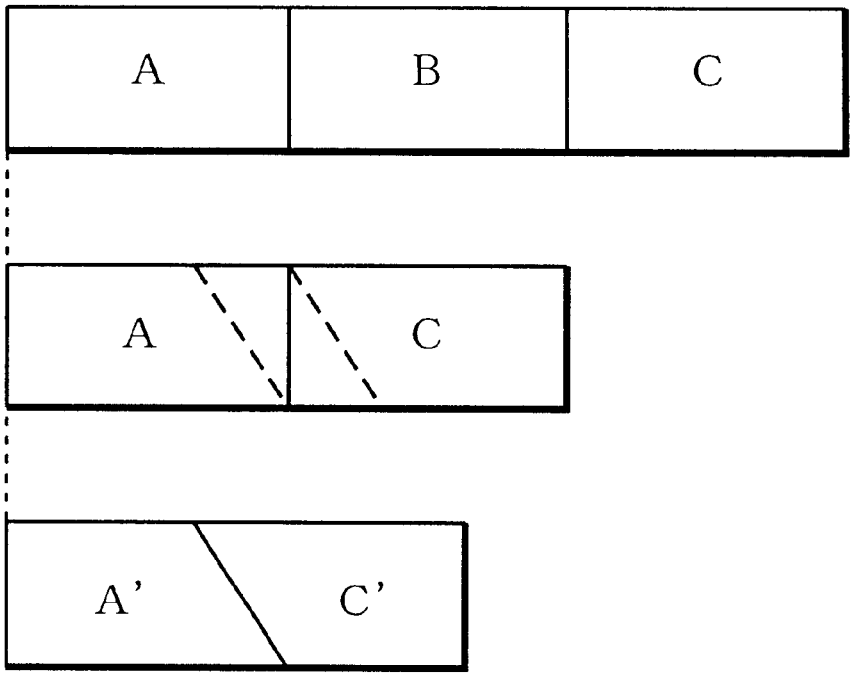
FIG. 17 PRIOR ART
FIG. 17 is a diagram in assistance of explaining the principle of a crossfading process for smoothly connecting insuccessive two sound frame.
Figure 18A:
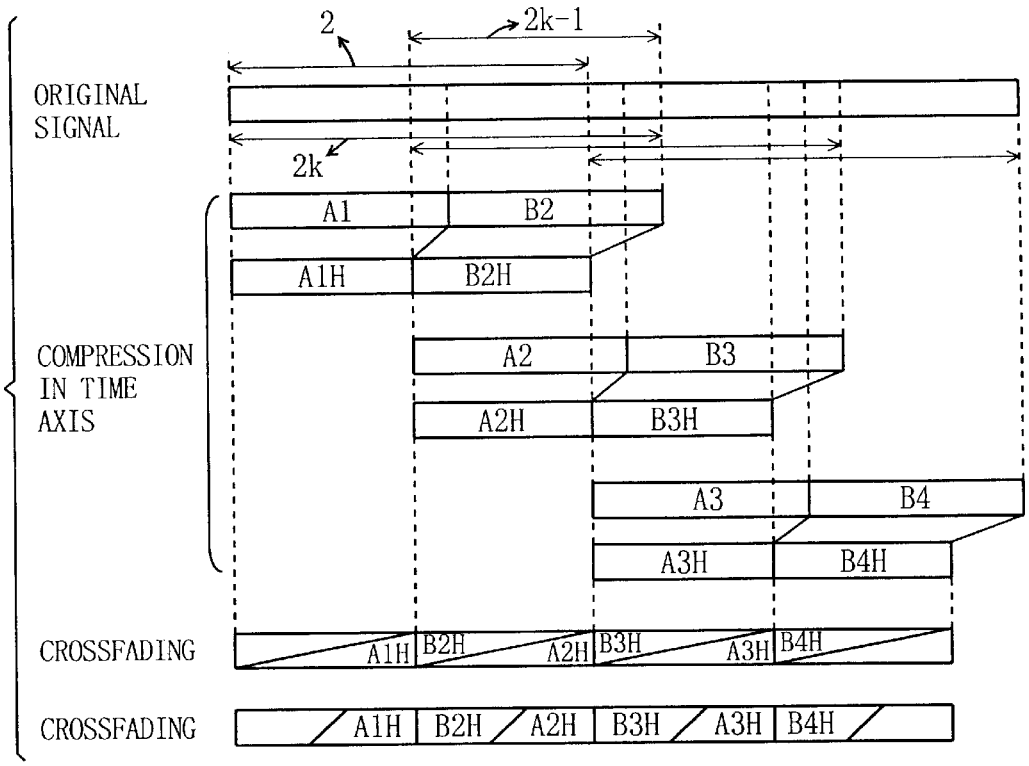
FIG. 18a PRIOR ART
FIGS. 18*a* and 18*b* are diagram in assistance of explaining the principle of shifting an acoustic signal in pitch to a desired level without any change in reproduction time through a combination of compression/extension along a time axis and crossfading.
Figure 18B:
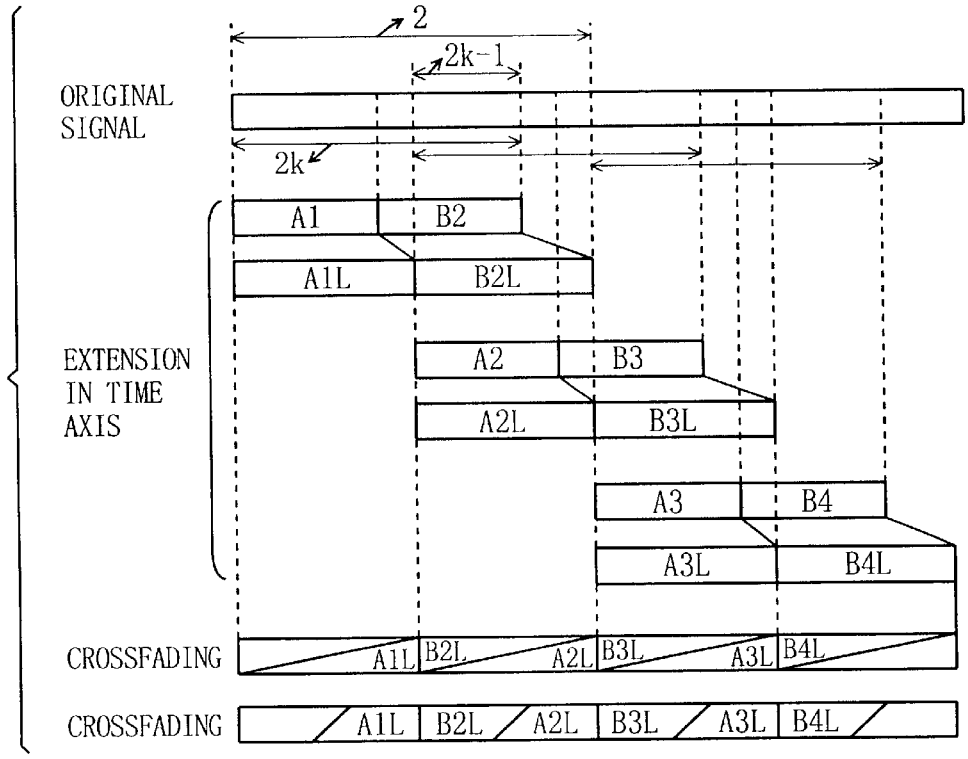
FIG. 18b PRIOR ART

FIG. 15 is a diagram schematically showing a relation between a position to which inputted sound data is written (write address pointer "w") and two positions from which the paired sound data are read based on the addresses given by the read address generator 4*a* (read address pointers "r1" and "r2"), where the pitch is shifted higher.

In FIG. 15, "w", "r1", and "r2" move with time as denoted by (a), (b), . . . , (l). The state denoted by (l) is the same as that denoted by (a), and the states (a) (b), . . . (l) repeat.

Throughout the states (a) to (l), "r1" and "r2" keep the positional relation as opposed to each other. "w" moves in the direction indicated by an arrow in each state. "r1" and "r2" move in the same direction but faster than "w". Note that a1 represents a distance between "w" and "r1", while a2 represents a distance between "w" and "r2". These have been described by using in FIG. 13.

The state (a) or (l) shows an instant when "r2" passes "w". At this instance, the sound data read from the position of "r2" becomes insuccessive.

The state (g) shows an instant when "r1" passes "w". At this instance, the sound data read from the position of "r1" becomes insuccessive.

The state (d) shows an instant when a1=a2.

Referring back to FIG. 12, the crossfader 3 multiplies the paired sound data read in the cycle T from the memory unit 1 by the paired crossfading coefficient, respectively. Then, the crossfader 3 adds two multiplication results together for output.

The crossfading coefficients by which the sound data read from "r1" and "r2" on the ring buffer are V(a1) and V(a2) respectively.

As known from FIGS. 14 and 15 in comparison, at the instance when the sound data read from the position of "r2" becomes insuccessive, (that is, the state (a)), V(a2)=0. Similarly, at the instance when the sound data read from the position of "r1" becomes insuccessive, (that is, the state (g)), V(a1)=0. Therefore, an output signal from the crossfader 3 is successive in value.

On the other hand, the filter coefficient string selector a selects, based on the given paired filter selection information, any one of four (N, in general) filter coefficient strings stored in the filter coefficient string storage 6. Then, the filter coefficient string selectors 5*a* reads the selected filter coefficient string to the filter operation unit 2*a*.

Note that the four filter coefficient strings stored in the filter coefficient string storage 6 are the same as those in the first embodiment. Also, the filter coefficient string selector 5*a* selects any one of these filter coefficient strings in a similar manner as that in the first embodiment.

The filter operation unit 2*a* carries out the filter operation based on the sound data from the memory unit 1 and the filter coefficient string from the filter coefficient string selector 5*a,* and calculates {y'(0), y'(k×1), y'(k×2), }.

The sound data after shifted in pitch {y'(0), y'(k×1), y'(k×2), . . . } outputted from the pitch shifter is again provided to the CD player through the sound data input terminal 27.

In FIG. 20, the sound data after shifted in pitch provided through the sound data input terminal 27 is given to the reproducer 22. The reproducer 22 reproduces the acoustic signal from the provided sound data after shifted in pitch.

The acoustic signal reproduced in the above-described manner is amplified through an amplifier (not shown), and then provided to the speaker, and converted into an acoustic wave. The acoustic wave reproduced from the sound data after shifted in pitch is similar to that shown in FIG. 2*c*.

While the invention has been described in detail, the foregoing description is in all aspects illustrative and not restrictive. It is understood that numerous other modifications and variations can be devised without departing from the scope of the invention.

What is claimed is:

1. A pitch shifter for shifting an acoustic signal in pitch to an arbitrary level without any change in reproduction time, said pitch shifter comprising:

a sound data input terminal sequentially provided discrete sound data produced by sampling said acoustic signal;

a pitch control signal input terminal provided with a pitch control signal indicating a pitch shift ratio;

paired read address generators each for generating, based on the pitch control signal provided through said pitch control signal input terminal, a read address differed from each other by a predetermined value;

a memory unit including a buffer, for sequentially writing, in the buffer, the sound data provided through said sound data input terminal and reading, from the buffer, paired sound data strings based on integer-part bits of each of the read addresses generated by said read address generators;

a filter coefficient string storage for storing, in a predetermined order, N filter coefficient strings corresponding to N sub-filters produced through polyphase decomposition of a low-pass filter for N-fold oversampling wherein N is a power of 2;

paired filter coefficient string selectors each for selecting, based on first to $\log_2$ N-th bits of a decimal part of each of the read addresses generated by said read address generators, any one of the N filter coefficient strings stored in said filter coefficient string storage;

paired filter operation units each for carrying out a filter operation on each of the paired sound data strings read by said memory unit by using the filter coefficient selected by said filter coefficient string selector; and a crossfader for multiplying each of paired sound data outputted from said filter operation units by a crossfading coefficient, and adding multiplication results together.

2. The pitch shifter according to claim 1, wherein each of said read address generators includes an accumulator for accumulating said pitch shift ratio.

3. The pitch shifter according to claim 1, wherein each of said read address generators includes an accumulator for accumulating a predetermined value, and a multiplier for multiplying an output from said accumulator by said pitch shift ratio.

4. The pitch shifter according to claim 1, wherein when reading the paired sound data strings from said buffer, said memory unit further reads, from the buffer, other paired sound data strings that are identical to or differed from the paired sound data strings in the address by one, said paired filter coefficient string selectors each further select other paired filter coefficient strings adjacent to the filter coefficient strings, said pitch shifter further comprises other paired filter operation units for carrying out the filter operation on the other paired sound data strings read by said memory unit by using the other filter coefficient strings selected by said filter coefficient string selectors; and paired interpolators, provided with the paired sound data outputted from said paired filter operation units and paired sound data outputted from said other paired filter operation units, for generating paired interpolation data interpolating two adjacent sound data by calculating a linear interpolation value with $\log_2$ N+1 bits or lower of each of the read addresses generated by said read address generators, and said crossfader is provided with paired sound data outputted from said paired interpolators.

5. The pitch shifter according to claim 4, wherein each of said read address generators includes an accumulator for accumulating said pitch shift ratio.

6. The pitch shifter according to claim 4, wherein each of said read address generators includes an accumulator for accumulating a predetermined value, and a multiplier for multiplying an output from said accumulator by said pitch shift ratio.

7. A pitch shifter for shifting an acoustic signal in pitch to an arbitrary level without any change in reproduction time, said pitch shifter comprising:

a sound data input terminal sequentially provided discrete sound data produced by sampling said acoustic signal;

a pitch control signal input terminal provided with a pitch control signal indicating a pitch shift ratio;

a single read address generator for generating, based on the pitch control signal provided through said pitch control signal input terminal, a read address;

a memory unit including a buffer, for sequentially writing, in the buffer, the sound data provided through said sound data input terminal and reading, from the buffer, paired sound data strings differed from each other by a predetermined number of addresses based on integer-part bits of each of the read addresses generated by said read address generator;

a crossfader for multiplying each of sound data forming the paired sound data strings read from said memory unit by a crossfading coefficient, and adding multiplication results together;

a filter coefficient string storage for storing N filter coefficient strings corresponding to N sub-filters produced through polyphase decomposition of a low-pass filter for N-fold oversampling N is a power of 2;

a single filter coefficient string selector for selecting, based on first to $\log_2$ N-th bits of a decimal part of the read address generated by said read address generator, any one of the N filter coefficient strings stored in said filter coefficient string storage; and a single filter operation unit for carrying out a filter operation on the sound data string outputted from said crossfader by using the filter coefficient selected by said filter coefficient string selector.

8. The pitch shifter according to claim 7, wherein said read address generator includes an accumulator for accumulating said pitch shift ratio.

9. The pitch shifter according to claim 7, wherein said read address generators includes an accumulator for accumulating a predetermined value, and a multiplier for multiplying an output from said accumulator by said pitch shift ratio.

10. The pitch shifter according to claim 7, wherein on said buffer, a write address pointer indicating a position to which the sound data inputted through said sound data input terminal is written and paired read address pointers each indicating a head position of each of said paired sound data read are provided, and said buffer is a ring buffer whose head and end are connected together and having capacity equivalent to a distance between said paired read address pointers, said memory unit gives a distance between either one of said paired read address pointers and said write address pointer, and said crossfader multiplies each of sound data forming said paired sound data strings by the crossfading coefficient according to the distance given from said memory unit.

11. The pitch shifter according to claim 10 wherein said read address generator includes an accumulator for accumulating said pitch shift ratio.

12. The pitch shifter according to claim 10, wherein said read address generators includes an accumulator for accumulating a predetermined value, and a multiplier for multiplying an output from said accumulator by said pitch shift ratio.

* * * * *

UNITED STATES PATENT AND TRADEMARK OFFICE

CERTIFICATE OF CORRECTION

PATENT NO. : 6,300,553 B1
DATED : October 9, 2001
INVENTOR(S) : Yoshinori Kumamoto et al.

It is certified that error appears in the above-identified patent and that said Letters Patent is hereby corrected as shown below:

Column 32,
Line 8, following "oversampling", insert -- wherein --.

Signed and Sealed this

Twenty-sixth Day of March, 2002

*Attest:*

*Attesting Officer*

JAMES E. ROGAN
*Director of the United States Patent and Trademark Office*